US009472359B2

(12) United States Patent
Ding et al.

(10) Patent No.: US 9,472,359 B2
(45) Date of Patent: Oct. 18, 2016

(54) TRIP LATCH ASSEMBLIES FOR CIRCUIT BREAKERS AND RELATED CIRCUIT BREAKERS

(71) Applicant: Eaton Corporation, Cleveland, OH (US)

(72) Inventors: CaiYing Ding, ShenZhen (CN); Chao Yang, ShenZhen (CN); Li Yu, Shanghai (CN); Wilbert Arthur Henrik deVries, Suzhou (CN)

(73) Assignee: Eaton Corporation, Cleveland, OH (US)

( * ) Notice: Subject to any disclaimer, the term of this patent is extended or adjusted under 35 U.S.C. 154(b) by 299 days.

(21) Appl. No.: 14/260,898

(22) Filed: Apr. 24, 2014

(65) Prior Publication Data

US 2015/0311009 A1 Oct. 29, 2015

(51) Int. Cl.

| | |
|---|---|
| ***H01H 1/52*** | (2006.01) |
| ***H01H 9/24*** | (2006.01) |
| ***H01H 3/30*** | (2006.01) |

(Continued)

(52) U.S. Cl.

CPC ..... *H01H 9/24* (2013.01); *H01H 3/3015* (2013.01); *H01H 3/3042* (2013.01); *H01H 9/20* (2013.01); *H01H 71/10* (2013.01); *H01H 2235/01* (2013.01)

(58) Field of Classification Search

CPC ..... H01H 9/24; H01H 9/20; H01H 3/3042; H01H 71/10; H01H 3/3015; H01H 2235/01

USPC ..... 200/400, 401, 500, 501, 318, 318.2, 200/320–325, 327

See application file for complete search history.

(56) References Cited

U.S. PATENT DOCUMENTS

| | | | |
|---|---|---|---|
| 2,470,675 | A | 5/1949 | Allan et al. |
| 3,906,805 | A | 9/1975 | Badger |

(Continued)

FOREIGN PATENT DOCUMENTS

| | | |
|---|---|---|
| DE | 2201938 | 7/1973 |
| DE | 2244825 | 3/1974 |

(Continued)

OTHER PUBLICATIONS

International Search Report and Written Opinion for corresponding PCT Application No. PCT/IB2015/052834, date of mailing Jul. 20, 2015, 12 pages.

(Continued)

*Primary Examiner* — Renee Luebke
*Assistant Examiner* — Lheiren Mae A Caroc
(74) *Attorney, Agent, or Firm* — Myers Bigel & Sibley, P.A.

(57) ABSTRACT

Circuit breakers that include and/or a trip latch assembly that is configured to maintain open and closed energy status of the breaker. The trip latch assembly can include: a first stop cam held on a cam shaft; a second stop cam held on the cam shaft axially spaced apart from the first stop cam; a drive cam held on the cam shaft; a trip-open latch held on a trip latch shaft, (typically above) in cooperating alignment with the first stop cam; a trip-close latch held on the trip latch shaft above and in cooperating alignment with the second stop cam; a follower residing below and in communication with the drive cam; and a linkage attached to the follower and to a main shaft to open and close the breaker responsive to the position of the drive cam.

19 Claims, 17 Drawing Sheets

(51) Int. Cl.
*H01H 9/20* (2006.01)
*H01H 71/10* (2006.01)

(56) References Cited

U.S. PATENT DOCUMENTS

| | | | | |
|---|---|---|---|---|
| 4,019,008 | A | 4/1977 | Kohler et al. | |
| 4,649,244 | A | 3/1987 | Baginski et al. | |
| 4,678,877 | A | 7/1987 | Nicoloso | |
| 4,996,397 | A | 2/1991 | Kuhn et al. | |
| 5,713,459 | A * | 2/1998 | Beck | H01H 71/505 200/400 |
| 6,180,902 | B1 | 1/2001 | Kowalyshen et al. | |
| 6,336,605 | B1 | 1/2002 | Littau | |
| 6,667,452 | B2 | 12/2003 | Spiegel | |
| 8,563,887 | B2 * | 10/2013 | Gottschalk | H01H 71/505 200/318 |
| 8,618,430 | B2 | 12/2013 | Staffas et al. | |
| 2001/0023620 | A1 | 9/2001 | Spurr | |
| 2006/0035739 | A1 | 2/2006 | Osborn | |
| 2014/0326092 | A1 | 11/2014 | Tokozakura | |

FOREIGN PATENT DOCUMENTS

| | | |
|---|---|---|
| DE | 19605711 | 8/1997 |
| EP | 1331654 | 7/2003 |
| EP | 2189995 | 5/2010 |
| EP | 2249361 | 11/2010 |

OTHER PUBLICATIONS

Eaton User manual W-VACi, 17.5kV W-VACiMB 25 kA 1250A IEC Mining Vacuum Circuit Breakers, 43 pages, Oct. 2012.

* cited by examiner

TRIP LATCH ASSEMBLIES FOR CIRCUIT BREAKERS AND RELATED CIRCUIT BREAKERS

FIELD OF THE INVENTION

The present invention relates to trip latch units for circuit breakers.

BACKGROUND OF THE INVENTION

Circuit breakers are one of a variety of overcurrent protection devices used for circuit protection and isolation. The circuit breaker provides electrical protection whenever an electric abnormality occurs. One type of circuit breaker is a vacuum circuit breaker that opens and closes primary circuits using vacuum interrupters (VI). A device used to open and close the circuit breaker (e.g., VI for vacuum breakers) is the operating mechanism or unit, which may be in the form of a modular, self-contained unit. The operating mechanism is configured to maintain opening and closing energy and facilitate closing an opening of the operation mechanism based on control from a trip latch assembly or unit. However, the trip open and trip close latch units can have relatively many parts that may reduce a life cycle and/or reliability of the operating mechanism.

SUMMARY OF EMBODIMENTS OF THE INVENTION

Embodiments of the present invention are directed to trip latch assemblies for circuit breakers.

In some embodiments, trip latch assemblies for a circuit breaker can include: a cam shaft; a drive cam attached to the cam shaft adapted to communicate with a follower that directs an actuator to move between open and close positions of a circuit breaker; at least one stop cam on the cam shaft, and at least one latch member in cooperating alignment with a respective at least one stop cam. The latch member cooperates with the stop cam to maintain the actuator in the open position and/or close position to thereby maintain open and closed energy status of the circuit breaker.

The first stop cam and the first latch member and the second stop cam and the second latch member can have self-recovery configurations to thereby automatically move through a sequence of positions to be reset for a subsequent trip event.

The at least one stop cam can include a first stop cam and a second stop cam held on the cam shaft with the drive cam therebetween. The trip latch assembly can include a trip-open latch and a trip close latch, each held by a trip latch shaft so that the trip-open latch resides above and in cooperating alignment with the first stop cam and the trip-close latch resides above and in cooperating alignment with the second stop cam. The trip-open and trip-close latches can have a respective downwardly extending leg that can tilt from vertical on the trip latch shaft. The trip-open and trip-close latches can be configured to cooperate with the first and second stop cams to hold and release closing and opening energy of an operator mechanism. The trip latch assembly can have a self-recovery configuration such that the trip-open latch and first stop cam and the trip-close latch and the second stop cam automatically move to reposition the trip-open latch and first stop cam and the trip-close latch and second stop cam to respective ready positions for a next trip event after respective trip events.

Embodiments of the present invention are directed to trip latch assemblies for a circuit breaker. The trip latch assemblies can include: (a) a cam shaft; (b) a drive cam attached to the cam shaft; and (c) at least one stop cam on the cam shaft.

The at least one stop cam can include a first stop cam and a second stop cam held on the cam shaft with the drive cam therebetween.

The stop cams can have the same size and perimeter shape.

The stop cams can have different size and different shaped perimeters.

The drive cam can have a perimeter profile with at least two circumferentially spaced apart lobes with valleys therebetween.

The at least one stop cam can have a perimeter profile with first and second ledges extending radially outward from a segment with a smaller radius to define respective holding points sized and configured to releasably receive a latch member.

The first and second ledges can be diametrically opposed.

The at least one stop cam perimeter profile may also include first and second fins that are circumferentially spaced apart with one of the holding points separating each side of the fins.

The first and second fins can be diametrically opposed.

The at least one stop cam includes a first stop cam and a second stop cam held on the cam shaft with the drive cam therebetween. The drive cam can include a perimeter profile with at least two circumferentially spaced apart lobes with valleys therebetween. The first and second stop cams can include a perimeter profile with (a) first and second ledges extending radially outward from a segment with a smaller radius that can define respective holding points sized and configured to releasably receive a latch member and (b) first and second fins that can define recovery points that are circumferentially spaced apart with one of the holding points separating each side of the fins.

The first and second ledges can be diametrically opposed. The first and second stop cams have the same size and perimeter shape.

The trip latch assembly can also include a trip-open latch held by a trip latch shaft to be above and in cooperating alignment with one of the at least one stop cams. The trip-open latch can have a downwardly extending leg that can tilt from vertical on the trip latch shaft.

The trip latch assembly can include a trip-close latch held by a trip latch shaft to be above and in cooperating alignment with one of the at least one stop cams. The trip-close latch can have a downwardly extending leg that can tilt from vertical on the trip latch shaft.

The at least one stop cam can include a first stop cam and a second stop cam held on the cam shaft with the drive cam therebetween. The trip latch assembly can include a trip-open latch and a trip close latch, each held by a trip latch shaft so that the trip-open latch resides above and in cooperating alignment with the first stop cam and the trip-close latch resides above and in cooperating alignment with the second stop cam. The trip-open and trip-close latches can have a respective downwardly extending leg that can tilt from vertical on the trip latch shaft. The trip open and trip close latches can be configured to latch a circuit breaker in open and close positions and make an automatic latch recovery by controlling the drive cam rotation using the first and second stop cams and the trip-open and trip-close latches.

The trip latch assembly can also include a follower residing against the drive cam and a main shaft in communication with the follower configured to maintain open and closed energy status of the circuit breaker via an operator mechanism.\

In some embodiments, circuit breakers can include: a drive cam held on a cam shaft; a follower in communication with the drive cam; a linkage attached to (i) the follower and (ii) a main shaft to open and close the circuit breaker; and a trip latch assembly configured to maintain open and closed energy status of the breaker. The trip latch assembly can include: a first stop cam held on the cam shaft; a second stop cam held on the cam shaft axially spaced apart from the first stop cam; a trip-open latch held on a trip latch shaft in cooperating alignment with the first stop cam; and a trip-close latch held on the trip latch shaft in cooperating alignment with the second stop cam. The trip latch assembly can be configured to latch the drive cam in trip open and trip closed positions and de-latch to release the drive cam and allow the drive cam to rotate to thereby hold and release closing and opening energy of an operator mechanism.

Other embodiments are directed to circuit breakers that include a trip latch assembly configured to maintain open and closed energy status of the breaker. The trip latch assembly can include: a first stop cam held on a cam shaft; a second stop cam held on the cam shaft axially spaced apart from the first stop cam; a drive cam held on the cam shaft; a trip-open latch held on a trip latch shaft in cooperating alignment with the first stop cam; a trip-close latch held on the trip latch shaft in cooperating alignment with the second stop cam; a follower residing in communication with the drive cam; and a linkage attached to the follower and to a main shaft to open and close the breaker responsive to the position of the drive cam.

The circuit breaker can be a vacuum circuit breaker.

The trip-open and trip-close latches comprise legs extending below the trip latch shaft that are able to tilt while held on the trip latch shaft in response to a profile shape of the first and second stop cams, wherein the profile shape of the stop cams comprise circumferentially spaced apart ledges that define respective first and second trip open and trip close holding points and circumferentially spaced apart fins that define first and second recovery points, and wherein the trip-open and trip close latches cooperate with the first and second stop cams to provide three different locked/latched positions: (a) an interlock position; (b) a trip close position; and (c) a trip-open position.

The trip-open and trip-close latches can each include an arm that extends inwardly to face a respective stop cam and a leg that extends below the arm and the trip latch shaft. The legs can be configured to be able to tilt while held on the trip latch shaft in response to a profile shape of the first and second stop cams.

The trip open and trip close latches can be configured to cooperate with the first and second stop cams to hold and release closing and opening energy of an operator mechanism using a single cam shaft, wherein the trip latch assembly has a self-recovery configuration such that the trip-open latch and first stop cam and the trip-close latch and the second stop cam automatically move to reposition the trip-open latch and first stop cam and the trip-close latch and second stop cam to a respective ready position for a next trip event after respective trip events whereby the trip-open latch and trip-close latch have a self recovery mode that does not require a spring.

Other embodiments are directed to methods of latching/de-latching a circuit breaker in/from open and closed positions. The methods include: (a) pushing an upper portion of a trip-open latch toward a first stop cam held on a cam shaft with a drive cam and a second stop cam to release the trip-open latch from a stop defined by a hold position on the first stop cam; then (b) automatically rotating the drive cam a defined amount sufficient to allow a change in energy status of the circuit breaker; then (c) rotating the second stop cam so that a trip close-latch engages a stop at a hold position on the second stop cam to thereby lock the drive cam in position; (d) automatically pivoting the trip-open latch and rotating the first stop cam from the hold position to a recovery positions so as to operate in a self-recovery sequence to be reset for a next trip event; and (e) automatically pivoting the trip-close latch and rotating the second stop cam from the hold position to a recovery positions so as to operate in a self-recovery sequence to be reset for a next trip event.

The methods can optionally also include automatically moving the trip-open latch to a recovery position using the second stop cam and the trip-close latch.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

FIGS. 19A-26A are side perspective views of an operational sequence from a trip opening to a trip closing configuration according to embodiments of the present invention. FIGS. 19B-26B are right side views of the devices shown in respective FIGS. 19A-26A. FIGS. 19C-26C are left side views of the devices shown in FIGS. 19A-26A (but also showing the drive cam on one side of the stop cams rather than between two stop cams according to embodiments of the present invention).

DETAILED DESCRIPTION OF EMBODIMENTS OF THE INVENTION

Figure 1A:
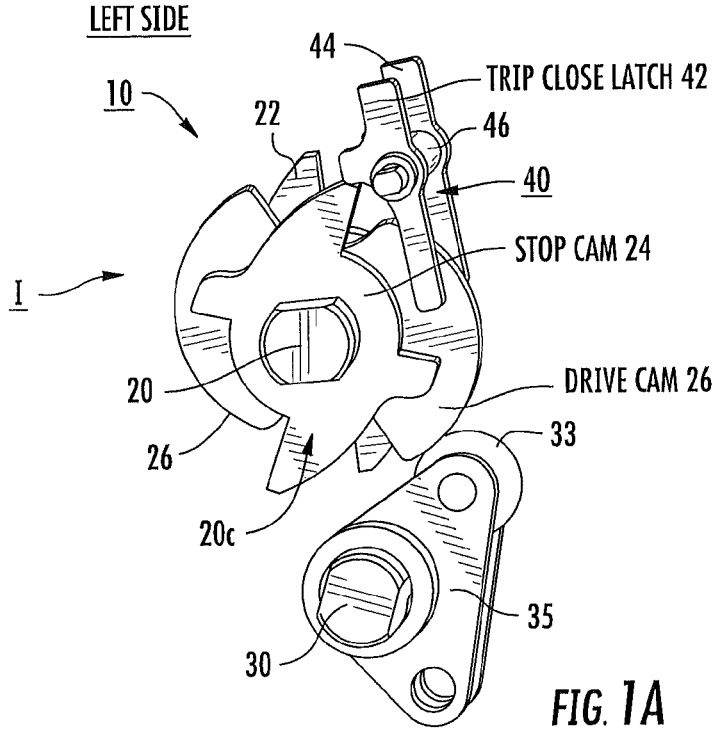
FIG. 1A is a left side perspective view of an exemplary trip latch assembly according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40'").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Although described and/or shown as "right" and "left" sides with respect to position, this description is merely used for clarity and the orientations of the components are not limited to these positions.

Figure 1B:
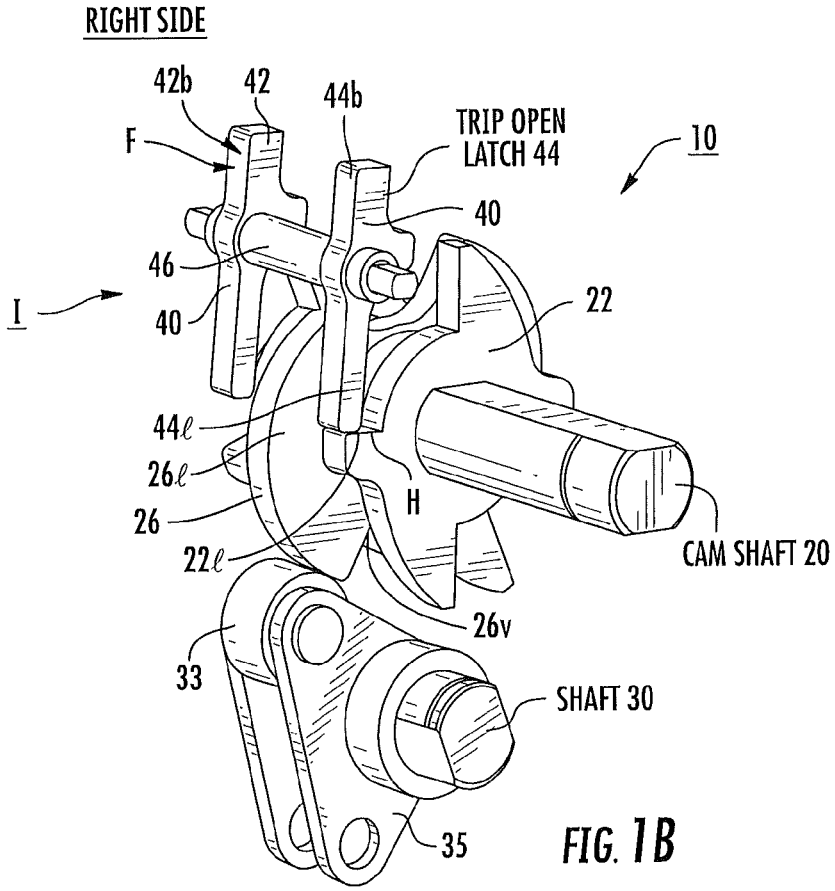
FIG. 1B is a right side perspective view of the trip latch assembly shown in FIG. 1A.

Turning now to the figures, FIGS. 1A and 1B illustrate a trip latch assembly 10. The trip latch assembly 10 includes a cam shaft 20 holding at least one stop cam 20*c*. Although shown as two stop cams 20*c*, more than two may also be used. It is also contemplated that one stop cam may be used in conjunction with a different latch configuration for the trip open latch or the trip close latch.

Typically the assembly 10 includes a plurality of axially spaced apart stop cams, shown as holding a first stop cam 22 and a second stop cam 24. The trip latch assembly 10 also includes at least one drive cam 26, typically a single drive cam that controls the opening and closing.

Figure 13:
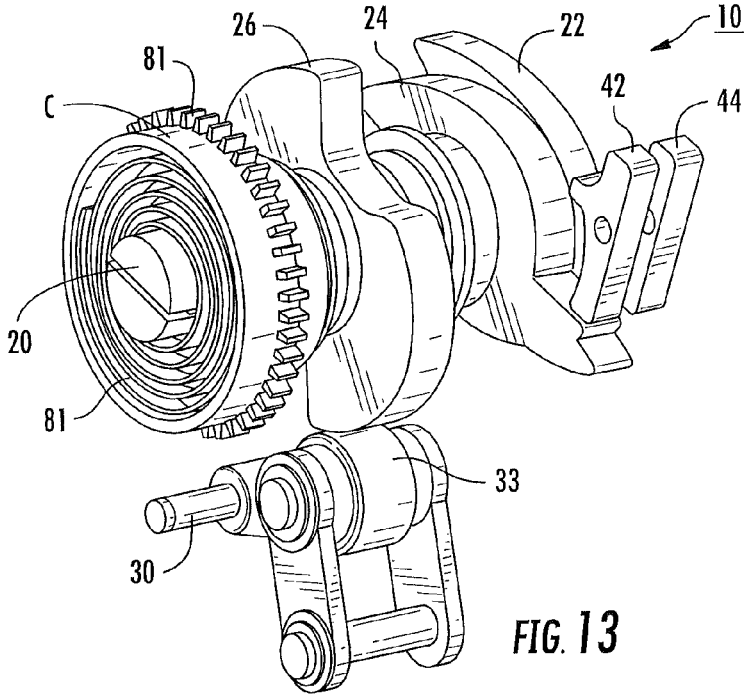
FIG. 13 is a side perspective view of an alternate embodiment of the trip latch assembly according to embodiments of the present invention.

The at least one stop cam 20*c* can be axially spaced apart from the drive cam 26 on the cam shaft 20. The spacing can vary, but can be such that there is between about 0.1 inches (about 2 mm) to about 6 inches (about 150 mm) between the drive cam 26 and an adjacent stop cam 20*c*, typically between about 10 mm to about 30 mm such as about 10 mm, about 12 mm, about 14 mm, about 15 mm, about 18 mm, about 20 mm, about 25 mm, or about 30 mm (or any number therebetween).

Where at least two stop cams are employed, the drive cam 26 can be held between two, e.g., the first and second stop cams 22, 24. Alternatively, the drive cam 26 may reside to one side of the two stop cams 22, 24, e.g., the right or left side (FIG. 13). The drive cam 26 can be aligned with and contact a follower 33 in communication with a main shaft 30. The follower 33 and the main shaft 30 can be held in a linkage 35 that allows the shaft 30 to pivot inside the breaker 100 (FIG. 10) in response to movement of the follower 33 against the drive cam 26 for the opening and closing operations. The linkage 35 can have various shapes and is not limited to that shown.

The trip latch assembly 10 also includes at least one latch 40, shown as including two latches, a trip-close latch 42 and a trip-open latch 44. The trip-open and trip-close latches 42, 44, respectively, can be held on a single trip latch shaft 46 as shown or may be held on separate shafts (not shown). The trip-close latch 42 is in cooperating alignment with the second stop cam 24 while the trip-open latch 44 is in cooperating alignment with the first stop cam 22. The trip-close and trip-open latches 42, 44, respectively, can move in response to the position and shape of the respective aligned stop cam 24, 22. Each stop cam 22, 24 can be keyed/fixed to the trip latch shaft 46 so that rotation of one stop cam can rotate the shaft and the other stop cam.

Figure 10:
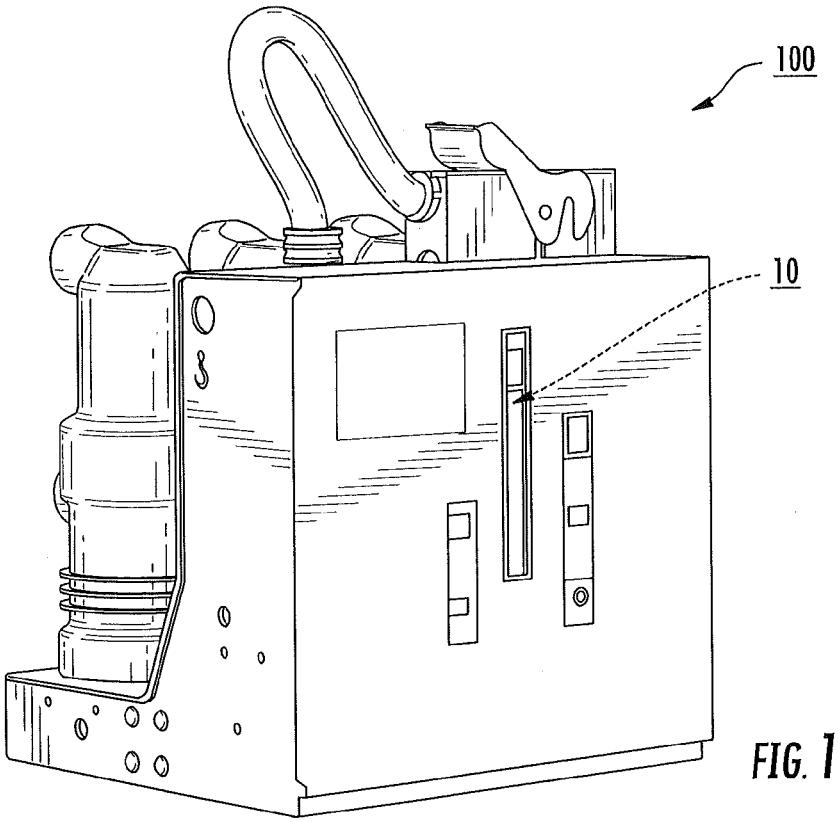
FIG. 10 is an exemplary circuit breaker that can include the trip latch assembly and operating mechanism according to some embodiments of the present invention.

The first and second stop cams 22, 24 can each be configured to be able to hold the drive cam 26 in desired open and close positions so as to open and close the breaker 100 (FIG. 10). That is, the first and second stop cams 22, 24 can be configured to (indirectly) hold the main shaft 30 in the opened and closed positions.

To change a "locked" status, a force F can be applied to the upper back portion 44*b* of the trip-open latch 44. This will pivot the trip-open latch 44 to disengage from the respective stop cam 22. In turn, this allows drive cam 26 to turn a sufficient amount before the trip-close latch 42 engages the next stop of the second stop cam 24 at trip open hold point one ($H_1$)(FIG. 3). Typically, the drive cam 26 moves between about 10 degrees to about 40 degrees from the trip-open latch release to the trip-close latch engagement, more typically between about 20-25 degrees, such as about 20 degrees, about 21 degrees, about 22 degrees, about 23 degrees or about 24 degrees. In this process, the trip-open latch 42 can be pushed back to its initial status by the second stop cam 24 (e.g., by turning the shaft 46 to tilt the trip-open latch).

FIGS. 1A and 1B illustrate an interlock configuration I when the operator mechanism 60 (FIG. 8) is in a closed breaker status. Thus, in the interlock configuration I pushing the trip-close latch 42 with a linkage, actuator, lever or other electromechanically operated member against upper end portion 42*b* with a force F will not cause a change in the drive shaft position.

In some embodiments, the first and second stop cams 22, 24 can be configured to hold the drive cam 26 in a desired position associated with a closed or open breaker position while held on the same cam shaft 20 and can also be configured to carry out a latch unit self-recovery.

The first and second stop cams 22, 24 can rotate in concert in response to movement of the drive cam 26. That is, the orientation of the stop cams 22, 24 and the drive cam 26 on the shaft 20 can be adjusted to match closed and open positions. Once the proper orientation of the shapes of the cams are determined, the cams 22, 24, 26 can all be fixed to the shaft 20 such that they do not rotate independently on the shaft 20.

The first and second stop cams 22, 24 and the drive cam 26 can all rotate in concert in response to movement of the cam shaft 20.

The stop cams 22, 24 can each be fixed to (e.g., keyed to) the cam shaft 20. Rotation of any cam 22, 24, 26 can rotate the shaft 20 and the other cam(s), such as rotation of one stop cam 22, 24 can rotate the other stop cam 24, 22 and the drive cam 26. Rotation of the drive cam 26 can rotate both the stop cams 22, 24.

Figure 2A:
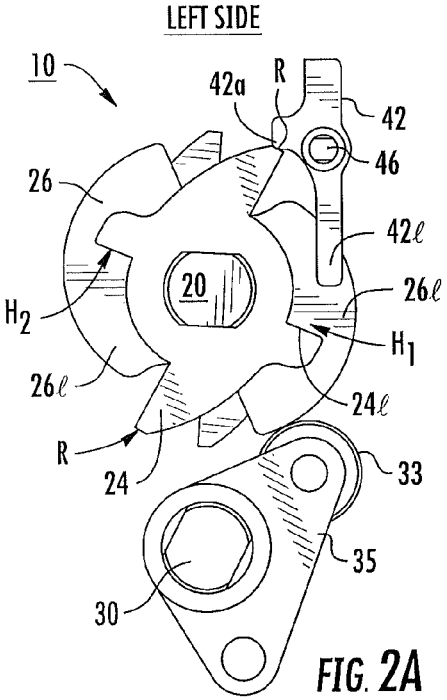
FIG. 2A is a left side view and FIG. 2B is a right side view of the trip latch assembly shown in FIGS. 1A and 1B, illustrated in a trip close position according to embodiments of the present invention.
Figure 2B:
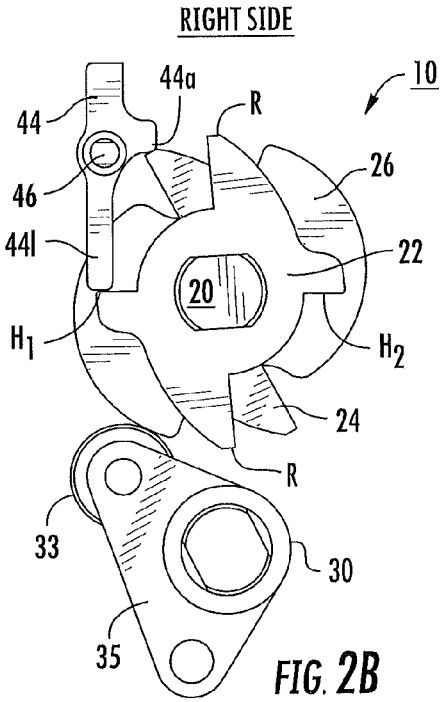
Figure 3A:
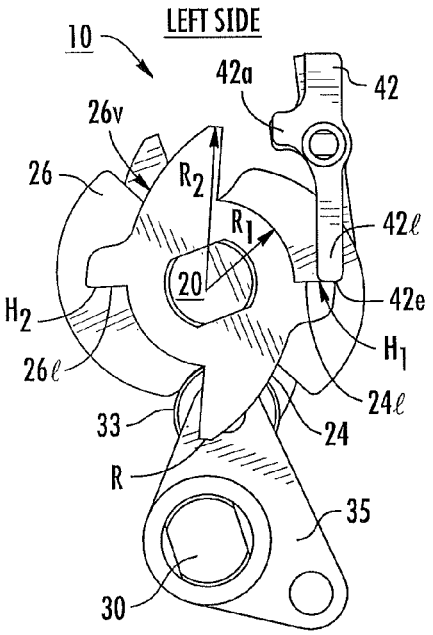
FIG. 3A is a left side view and FIG. 3B is a right side view of the trip latch assembly shown in FIGS. 1A and 1B, illustrated in a trip open position according to embodiments of the present invention.
Figure 3B:
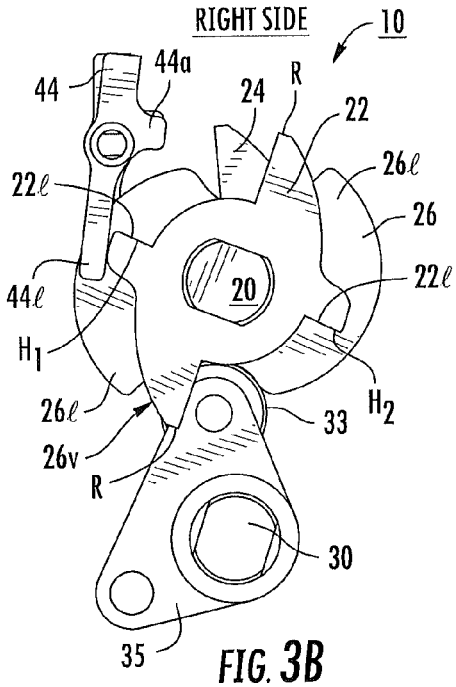
Figure 4A:
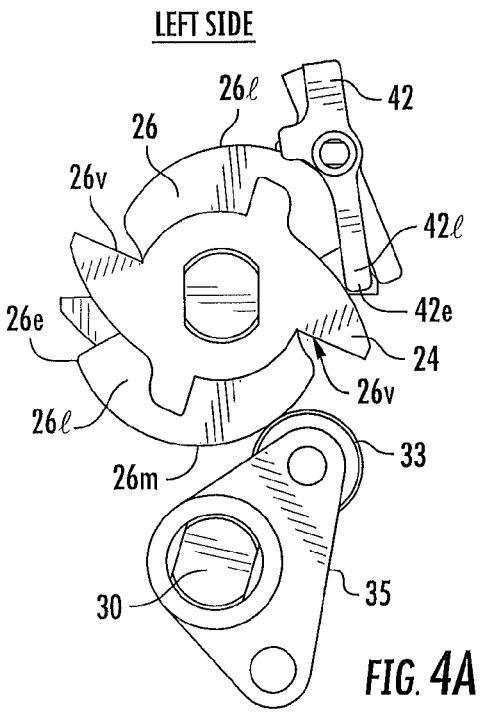
FIG. 4A is a left side view and FIG. 4B is a right side view of the trip latch assembly shown in FIGS. 1A and 1B, illustrating exemplary component orientation and position from a trip open position to a trip close position, according to embodiments of the present invention.
Figure 4B:
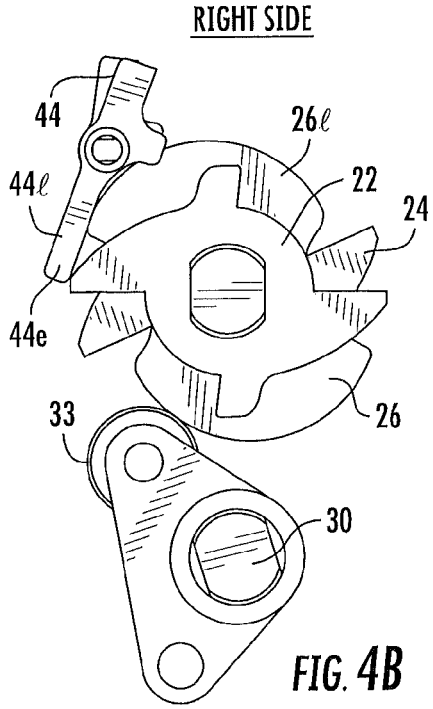
Figure 5A:
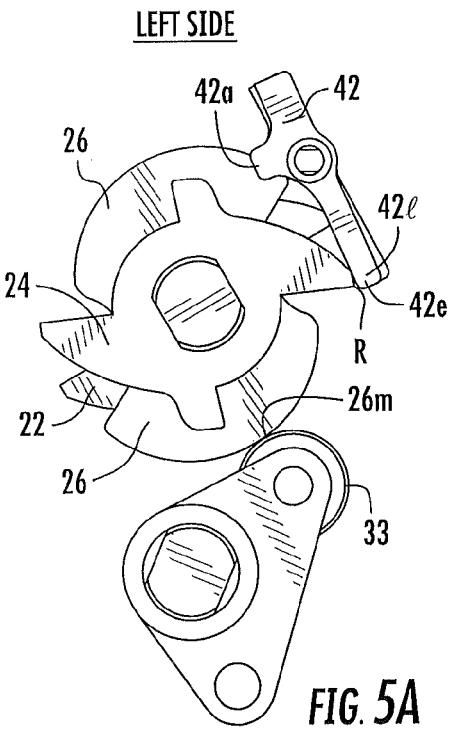
FIG. 5A is a left side view and FIG. 5B is a right side view of the trip latch assembly shown in FIGS. 1A and 1B, illustrating exemplary component orientation and position from a trip open position to a trip close position, according to embodiments of the present invention.
Figure 5B:
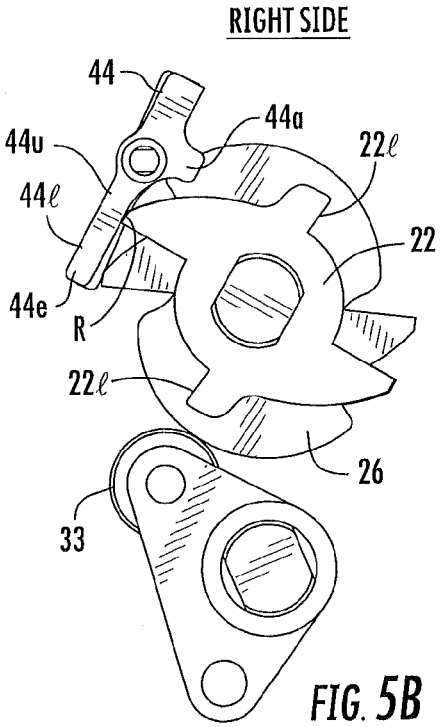

FIGS. 2A and 2B illustrates a trip close position with the follower 33 in contact with a lobe 26*l* of the drive cam 26 to position the drive shaft 30 away from the cam shaft 20 and/or stop cams 22, 24. FIGS. 3A and 3B illustrate a trip open position with the follower 33 in the cam valley 26*v* allowing the main shaft 30 to reside closer to the cam shaft 20 and/or the stop cams 22, 24 relative to the trip close position (e.g., FIGS. 2A and 2B). As noted above, FIG. 1 illustrates an interlock I position. In the interlock position I, the first stop cam 22 engages the leg 44*l* of the trip open latch 44 at the ledge 22*l* forming a holding point H.

In some embodiments, the first and second stop cams 22, 24 can have the same size and shape, including the same cam surface perimeter profile shape. The trip-open and trip-close latches 42, 44 can also have the same shape and size. However, it is also contemplated that the stop cams 22, 24 can have different sizes and/or shapes as may respective latch members 42, 44.

The trip latch shaft 46 can be held at a position that is above and laterally offset from the cam shaft 26 to hold at least one of the trip-open or trip-close latch in cooperating alignment with a respective stop cam 20*c*.

Referring to FIGS. 2A, 2B, 3A and 3B, as shown, the stop cams 22, 24 can be configured to have at least two hold points $H_1$, $H_2$, shown as two hold points. The hold points $H_1$, $H_2$ can be configured with respective planar ledges 22*l*, 24*l* extending radially outward a distance from an adjacent segment with a smaller radial dimension. The ledges 24*l*, 22*l* can be sized and configured to receive a lower end of a leg 42*l*, 44*l* of a corresponding trip-open latch 44 or trip-close latch 42. Optionally, the ledges 22*l*, 24*l* can have embossed, scored and/or coated surfaces to increase surface friction and therefore frictional engagement of the lower end of the legs 42*l*, 44*l*.

As shown, the stop cams 22, 24 can be configured to have at least one (shown as two) recovery point R. The at least one recovery point R resides between the holding points $H_1$, $H_2$. In the exemplary embodiment shown, the stop cams 22, 24 each have two circumferentially spaced apart recovery points R, one between each hold point $H_1$, $H_2$. The stop cams 22, 24 can be configured with a curvilinear shape that forms two holding point ledges and two fins that taper outward to a maximal radius $R_2$ at the recovery point R, then extend straight in at an orthogonal surface to a segment having a first smaller radius $R_1$ (FIG. 3A). The hold points $H_1$, $H_2$ can be diametrically opposed as can be the recovery points R, where two recovery points are used.

In some embodiments, the drive cam 26 can have two diametrically opposing arcuate lobes 26*l* circumferentially spaced apart by inwardly curved valleys 26*v*. However, other drive cam configurations may be used. For example, the drive cam 26 can include more than two circumferentially spaced apart lobes 26*l*.

In the trip close position, as shown in FIGS. 2A and 2B, a lower leg 42*l* of the trip-close latch 42 is not in a hold position $H_1$ or $H_2$ and is typically not even in contact with the second stop cam 24. However, an arm 42*a* of the trip-close latch 42 proximate the shaft 46 can contact/rest against a recovery point R on the stop cam 24. The trip-close latch 42 can be configured so that the leg 42*l* extends downwardly to be substantially vertical (+/−10 degrees of vertical) in the trip close position and resides above a trip open hold point $H_1$. As shown in FIG. 2B, the leg 44*l* of the trip open latch 44 resides on the trip close holding point $H_1$ of the second stop cam 24 allowing the second cam 24 to make the trip close latch recovery.

Figure 6A:
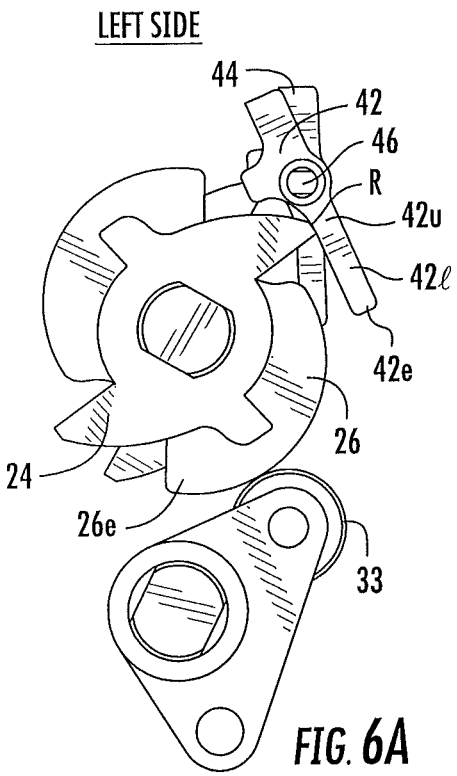
FIG. 6A is a left side view and FIG. 6B is a right side view of the trip latch assembly shown in FIGS. 1A and 1B, illustrating exemplary component orientation and position from a trip open position to a trip close position, according to embodiments of the present invention.
Figure 6B:
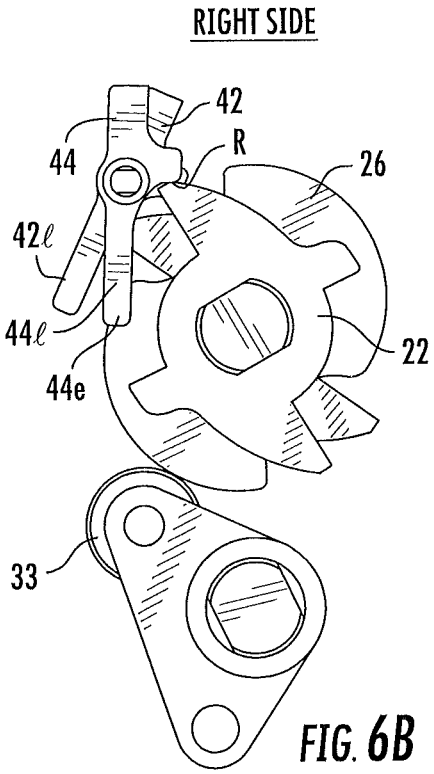
Figure 7A:
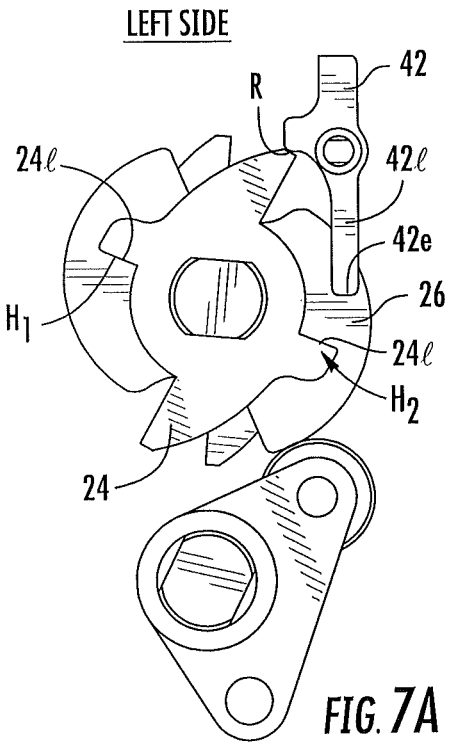
FIG. 7A is a left side view and FIG. 7B is a right side view of the trip latch assembly shown in FIGS. 1A and 1B, illustrating exemplary component orientation and position from a trip open position to a (second) trip close position, according to embodiments of the present invention.
Figure 7B:
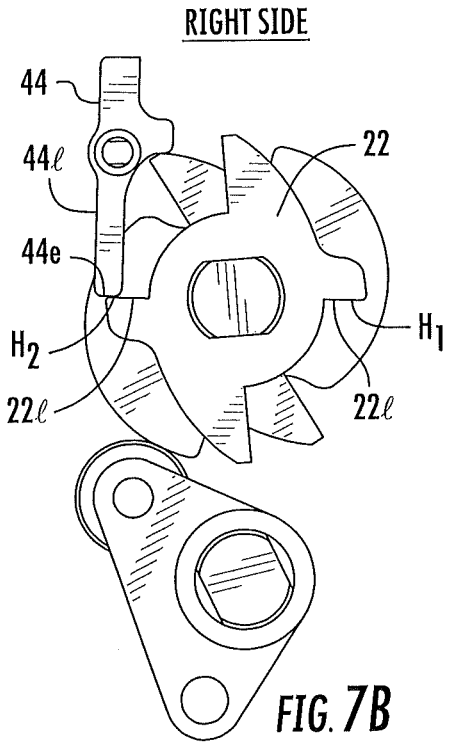

FIGS. 3A, 3B to 7A-7B illustrate component position and movement from a trip open position to a trip close position. FIGS. 7A and 7B illustrate the second trip close position (FIGS. 2A and 2B illustrate the first trip close position).

The trip-close latch 42 and stop cam 24 can serially move so that the trip close latch 42 goes from being upstanding in the trip open position with the lower end of the leg 42*e* on the hold point $H_1$ of the stop cam 24 (FIG. 3A), to a tilted outward position between a recovery point R and the stop cam 24 holding points $H_1$, $H_2$ (FIG. 4A), to tilt further with the lower end of the leg 42*e* contacting the recovery point R (FIG. 5A), to tilt with the stop cam 24 rotated to position a recovery point R adjacent the trip latch shaft 46 at an upper end of the leg 42*u* (FIG. 6A). In the second trip close position (FIG. 7A), the trip close latch 42 is again substantially upright (e.g., vertical) with the lower end 42*e* above the ledge 24*l* forming the hold point $H_2$.

The trip-open latch 44 and the stop cam 22 can serially move as shown in FIGS. 3B, 4B, 5B, 6B and 7B from the trip open position to the trip closed position. In the trip open position, the trip-open latch 44 moves from a position with the lower end of the leg 44*l* abutting an outer surface of the stop cam 22 proximate the ledge 22*l* at hold point $H_1$ (FIG. 3B), to tilt further out and reside approximate recovery point R (with the stop cam 22 placing the recovery point adjacent the lower end of the leg 44*e* while the hold points $H_1$, $H_2$, and associated ledges 22*l* are substantially vertical (FIG. 4B), to tilt and allow the recovery point R to move upward on the leg 44*l* to an upper portion of the leg 44*u* (FIG. 5B) to then move to have the arm 44*a* contact the recovery point R (FIG. 6B), then move to the trip close position with the lower end of the leg 44*e* residing on the trip close ledge at hold pint $H_2$ (FIG. 7B).

The drive cam 26 moves as allowed by the stop cams 22, 24 and latch members 42, 44 to move the follower 33 and hence the main shaft 30. The drive cam 26 rotates from the trip open position with the follower in a valley 26*v* with the follower residing closer to the cam shaft 20 and/or stop cams 22, 24 (FIG. 3A), to position the follower over an end of one of the lobes 26*l* (FIGS. 4A, 4B), to a more medial location 26*m* along the lobe 26*l* (FIGS. 5A, 5B) to the other end of the lobe 26*e* with the follower 33 positioned further away from the cam shaft 20 and/or the stop cams 22, 24 (FIGS. 6A, 6B to 7A, 7B).

Figure 8A:
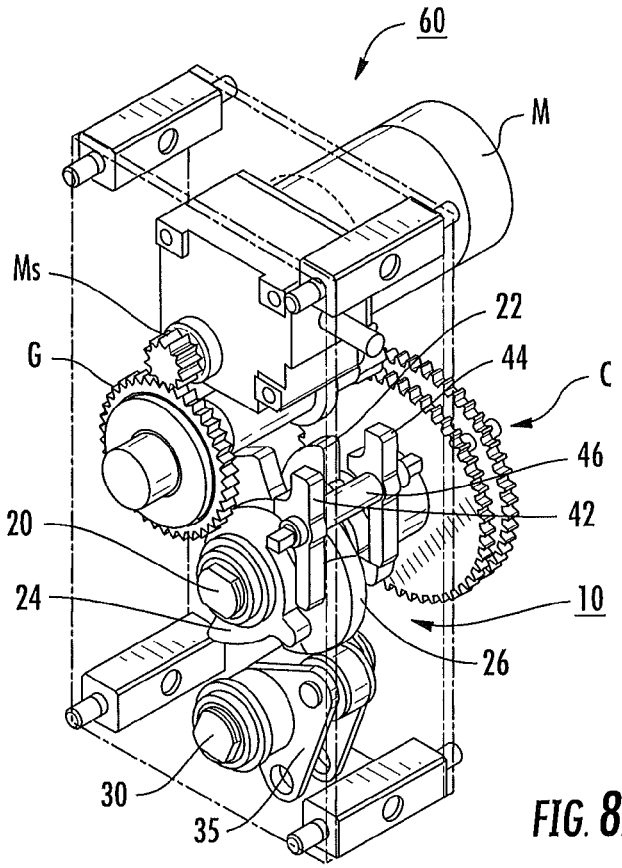
FIG. 8A is a partial exploded view of an operator mechanism with the trip latch assembly according to embodiments of the present invention.
Figure 9:
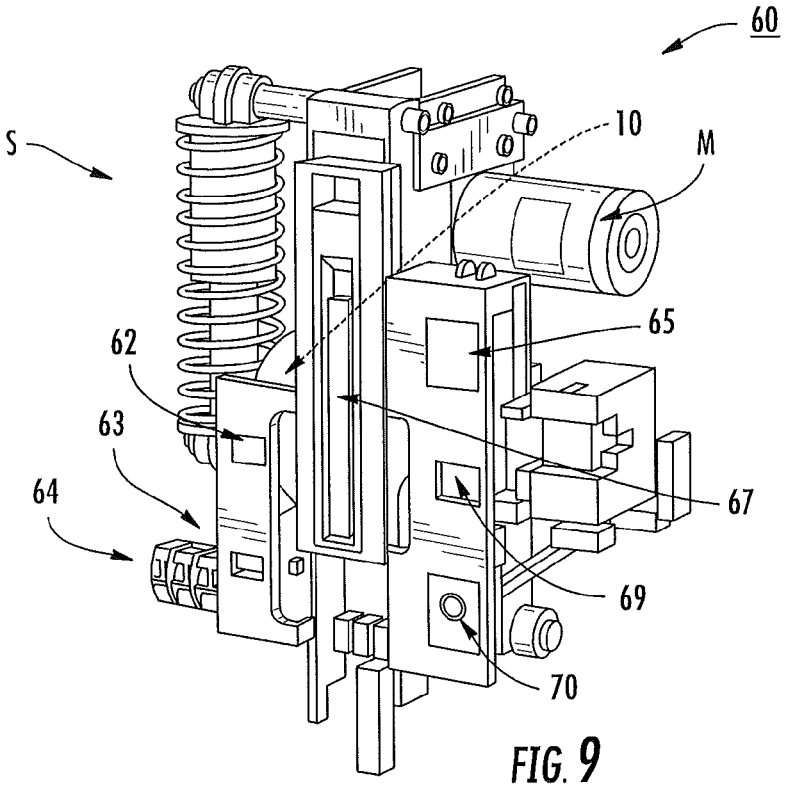
FIG. 9 is an exemplary operating mechanism with the trip latch assembly shown in FIGS. 1A and 1B according to embodiments of the present invention.
Figure 11:
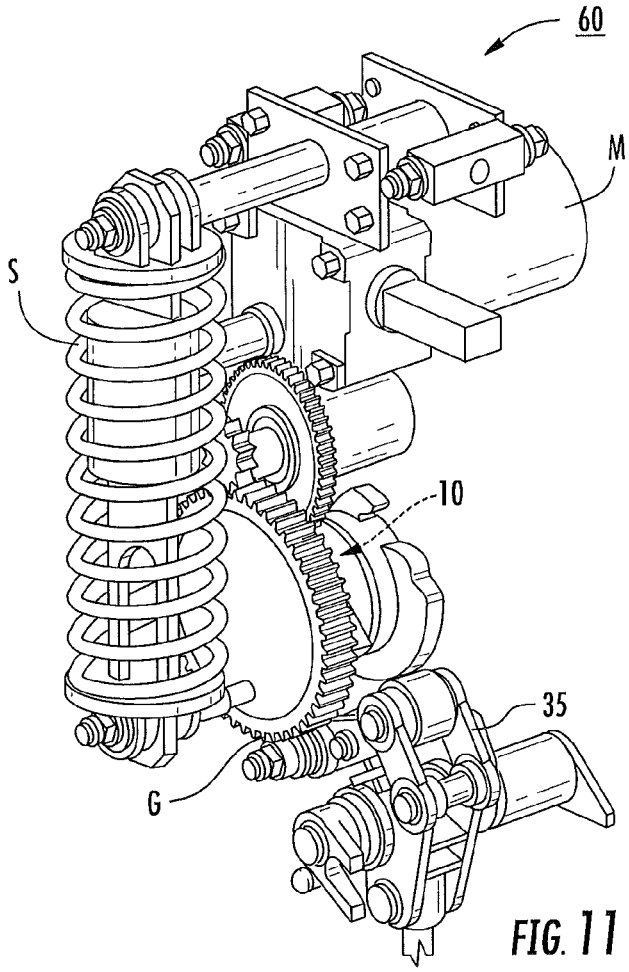
FIG. 11 is a side perspective view of an operator mechanism according to some embodiments of the present invention.

FIGS. 8A, 9 and 11 illustrate examples of operator mechanisms 60 comprising the latch assembly 10. The operator mechanism 60 also typically includes an electric motor M.

Referring to FIG. 9, the mechanism 60 can include a charge indicator 62, an operations counter 63, auxiliary switches 64, user interfaces for close input 65 and open input 70 and associated open/close indicator 69. The mechanism 60 may also include a manual charging handle 67.

FIG. 9 also illustrates that the motor M is in communication with a closing spring S and a gear G. The latch assembly 10 can be provided as a part of a modular "universal" mechanism assembly (UMA) as shown in FIGS. 9 and 11.

Figure 8B:
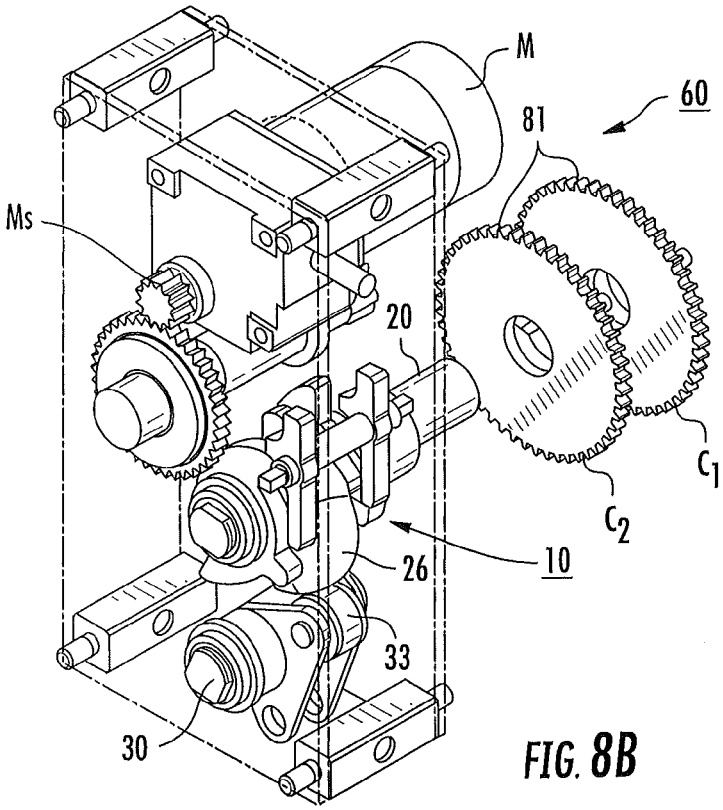
FIG. 8B is a partial exploded view of the mechanism shown in FIG. 8A with a clock spring shown in exploded view aligned with but off the cam shaft according to embodiments of the present invention.
Figure 8C:
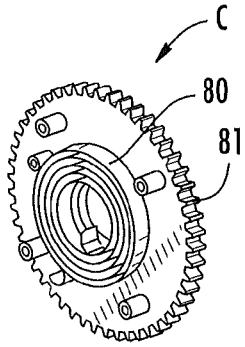
FIG. 8C is a side perspective view of an exemplary clock spring according to embodiments of the present invention.

In other embodiments, as shown in FIGS. 8A and 8B, the operator mechanism 60 can operate using at least one clock spring C as the closing spring in lieu of the tension coil closing spring S. A clock spring is a spiral-wound torsion spring 80 (FIG. 8C) that can mediate a spring force between two or more coaxial shafts, e.g., the cam shaft 20 and the main shaft 30 or motor shaft Ms. The number of revolutions in the spiral geometry is positively correlated to the spring rate.

Figure 12A:
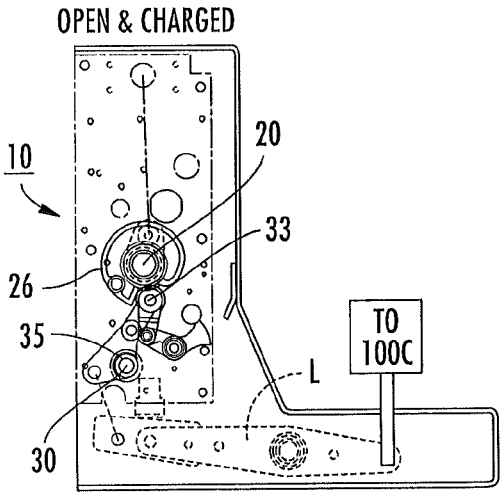
FIGS. 12A and 12B are side schematic illustrations of an open and charged configuration and a closing and uncharged configuration of a circuit breaker according to embodiments of the present invention.
Figure 12B:
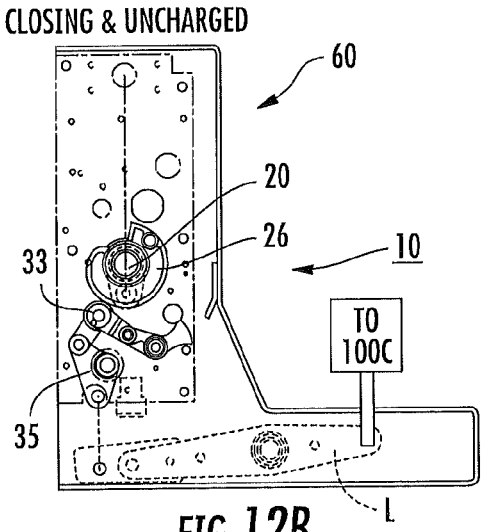
Figure 17A:
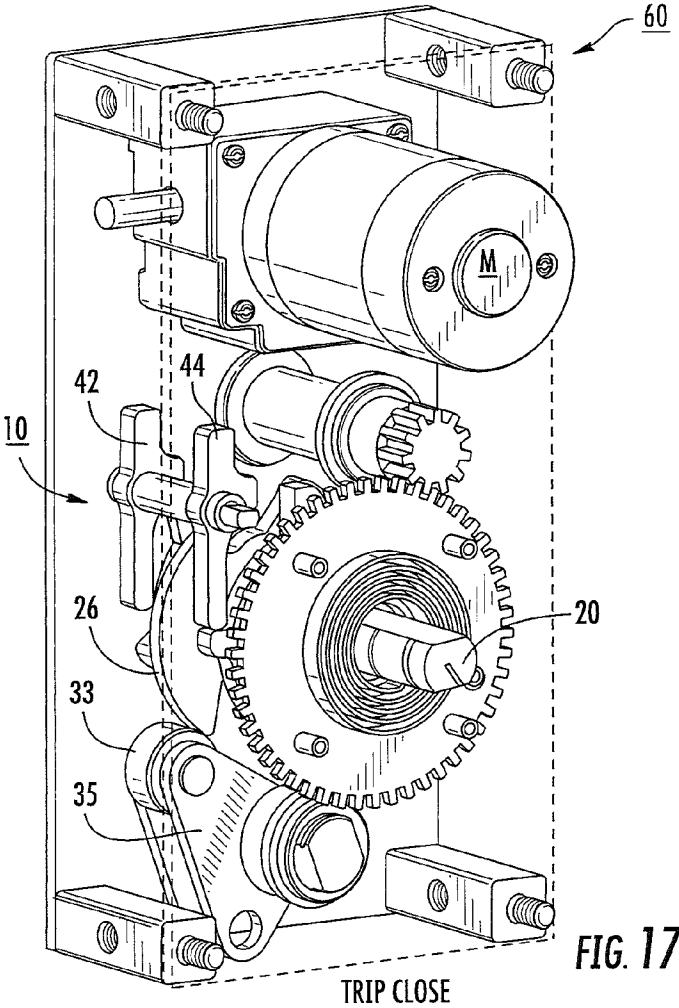
FIG. 17A is a partial side perspective view of an exemplary operator mechanism in a trip close position according to embodiments of the present invention.
Figure 17B:
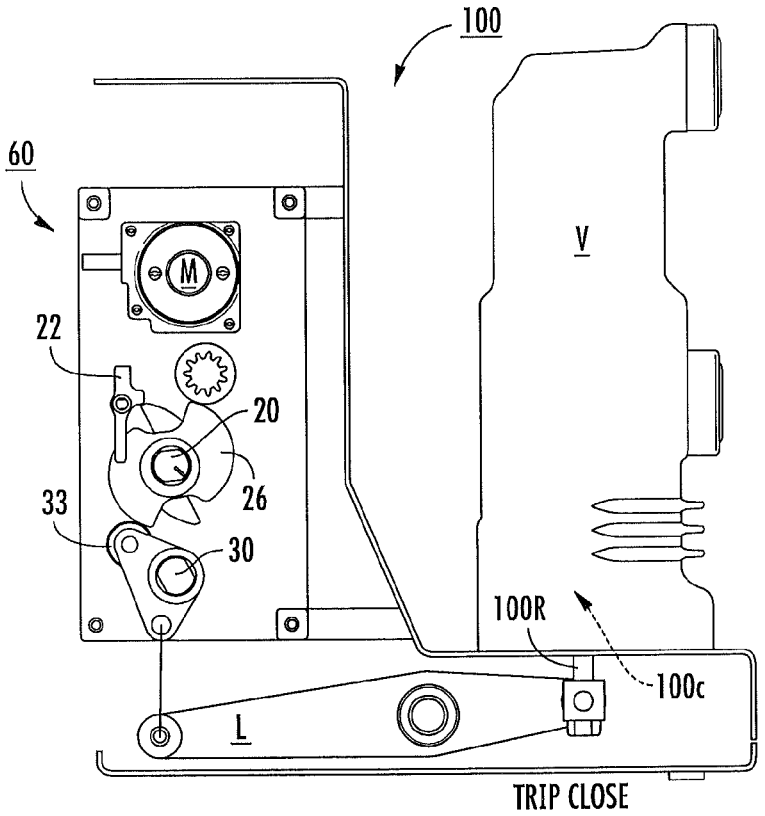
FIG. 17B is a cutaway side view of the operator mechanism shown in FIG. 17A as it is connected to a linkage that moves contacts to open and close a circuit breaker according to some embodiments of the present invention.
Figure 17C:
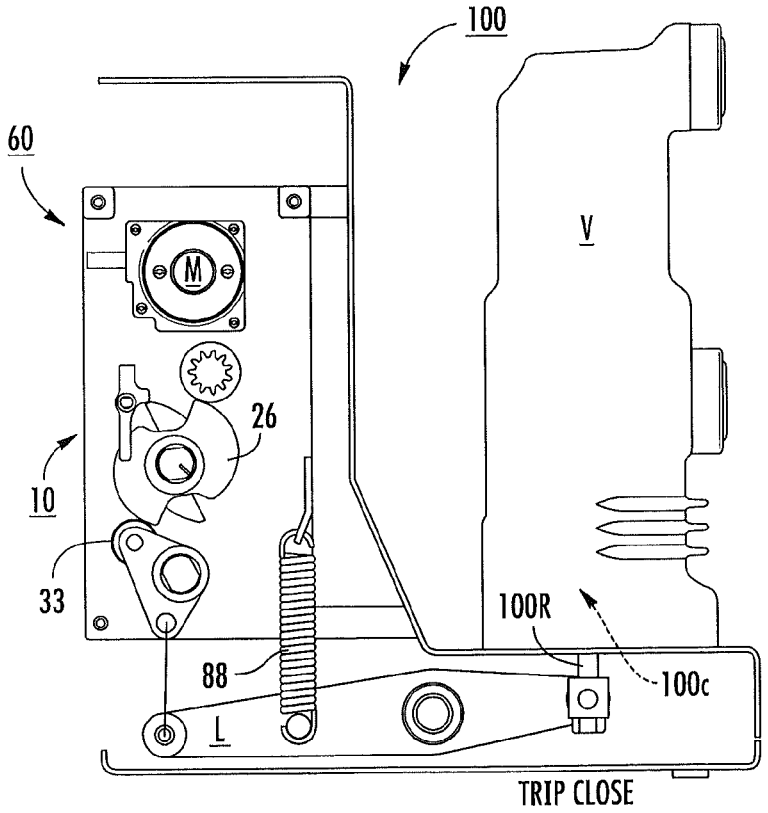
FIG. 17C is a cutaway side view of the operator mechanism shown in FIG. 17B and also illustrating an exemplary opening torsion spring according to embodiments of the present invention.

The clock spring C is charged by motor M and drive the cam to pull the VCB closing and opening, e.g., move the mobile (movable) contact for the VI at the closing point (FIG. 12B, 17B, 17C). The opening operation sequence can be such that when the trip open latch 44 is tripped, the drive cam 26 is rotated clockwise by the clock spring C (or other closing spring configuration), the shaft 30 will be rotated clockwise by the torsion spring 88 without support by the drive cam 26, then the VI is opened.

FIG. 10 illustrates an exemplary circuit breaker 100 that can include the trip latch assembly 10. The circuit breaker 100 can be a vacuum circuit breaker of any rating. Breakers are available in various sizes typically as small, medium and large units with arc extinguishing units such as vacuum interrupters, e.g., low, medium or high voltage circuit breakers. In particular embodiments, the vacuum circuit breaker can be a medium voltage circuit breaker such as the breaker cradles 10 can be any voltage type or configuration for power circuit breakers. By way of example, but without limitation, the breakers can include medium voltage type units, e.g., between about 1 kV to about 72 kV, including about 3 kV, about 5 kV, about 12 kV, about 24 kV, about 38 kV, about 40.5 kV and the like. However, the latch assemblies 10 may also be used with high voltage (greater than 72 kV) or low voltage type units (less than 1 kV).

FIG. 12A illustrates an open and charged configuration of the operator mechanism and FIG. 12B illustrates a closing and uncharged configuration.

FIG. 13 illustrates that where two stop cams are used they can reside adjacent each other with the drive cam 26 closer to one of them. The drive cam 26 may reside between one of the stop cams 20*c* (e.g., 24).

Figure 14:
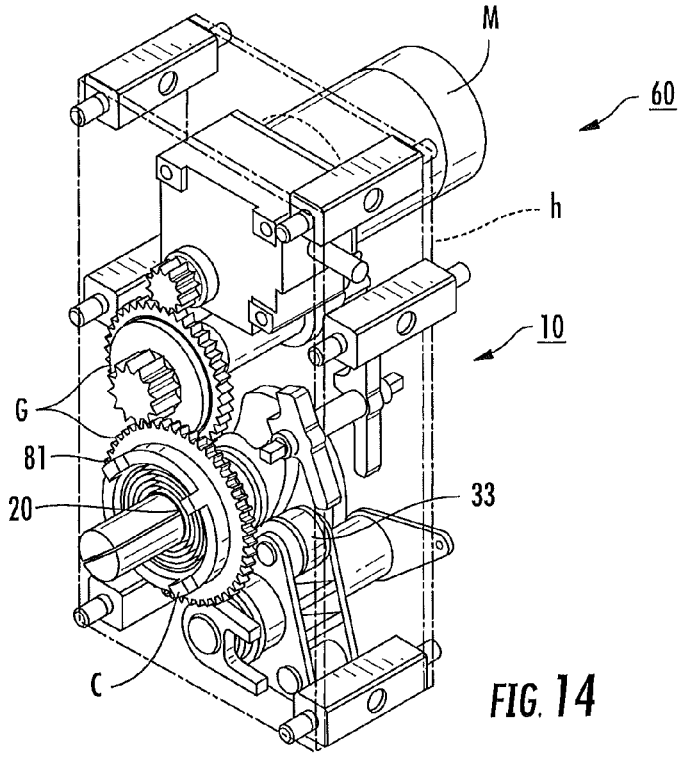
FIG. 14 is a side perspective view of an operator mechanism of an operator mechanism with a spring (clock spring) gear according to embodiments of the present invention.

FIG. 14 also illustrates the operator mechanism can be held in a modular housing h with the spiral spring 81 facing away from the stop cams 20*c*. However, the spiral spring 81 can also face the stop cams 20*c* or reside between two stop cams, 22, 24.

The cam shaft 20 can be axially fixed in position. The latch assembly 40 can hold and release the closing and opening energy of the mechanism 10 using one shaft 20. The cam shaft 20 is not required to axially translate for the open and close positions (e.g., the same axial position of the shaft 20 can be used for both closing and opening positions).

Thus, in operation, by way of example of some embodiments, the cam shaft 20, the drive cam 26 and the spiral spring 81 of the at least one clock spring C will rotate and push the linkage 35 to close the contacts 100*c* at a drive cam closing point associated with respective lobes. An opening torsion spring 88 (FIG. 17C) may be used to push the linkage 35 back to separate the contacts 100*c* at a drive cam 26 opening point (associated with a cam valley 26*v*). Optionally, the drive cam 26 may have a plurality (typically two or three) spaced apart lobes 26*l* with associated respective closing points over its perimeter allowing for less than a full turn of the drive cam 26 for each trip close position.

Figure 15:
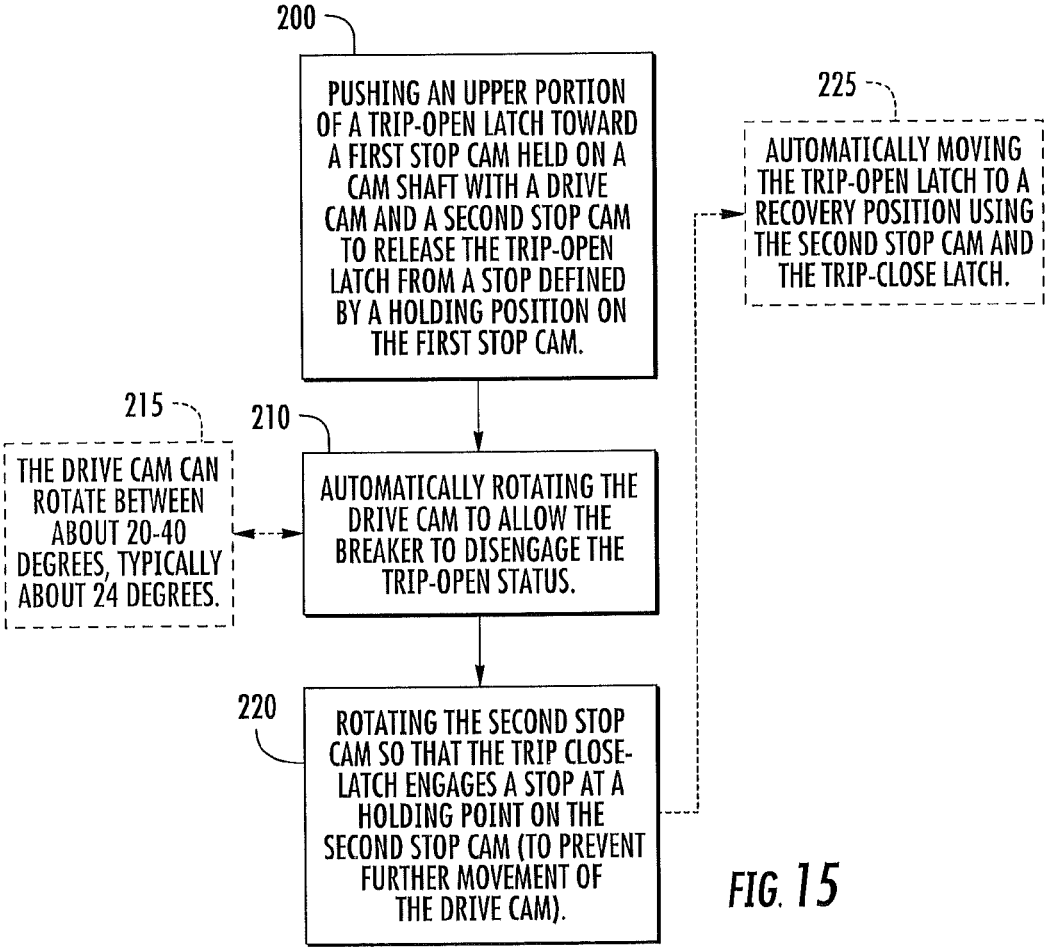
FIG. 15 is a flow chart of exemplary operations that can be used to carry out trip latch functions in a circuit breaker according to embodiments of the present invention.

FIG. 15 illustrates exemplary operations that can be used to latch a circuit breaker in open and closed positions. The methods can include: (a) pushing an upper portion of a trip-open latch toward a first stop cam held on a cam shaft also holding a drive cam and a second stop cam to release the trip-open latch from a stop defined by a holding position on the first stop cam (block 200); then (b) automatically rotating the drive cam (block 210); then (c) rotating the second stop cam so that the trip close-latch engages a stop at a holding point on the second stop cam (block 220) (to prevent further movement of the drive cam).

The drive cam rotation, post trip-open release, can be between about 20-40 degrees before the second stop cam prevents further movement (block 215), typically about 24 degrees.

The method can also include automatically moving the trip-open latch to a recovery position using the second stop cam and the trip-close latch (block 225).

Figure 16B:
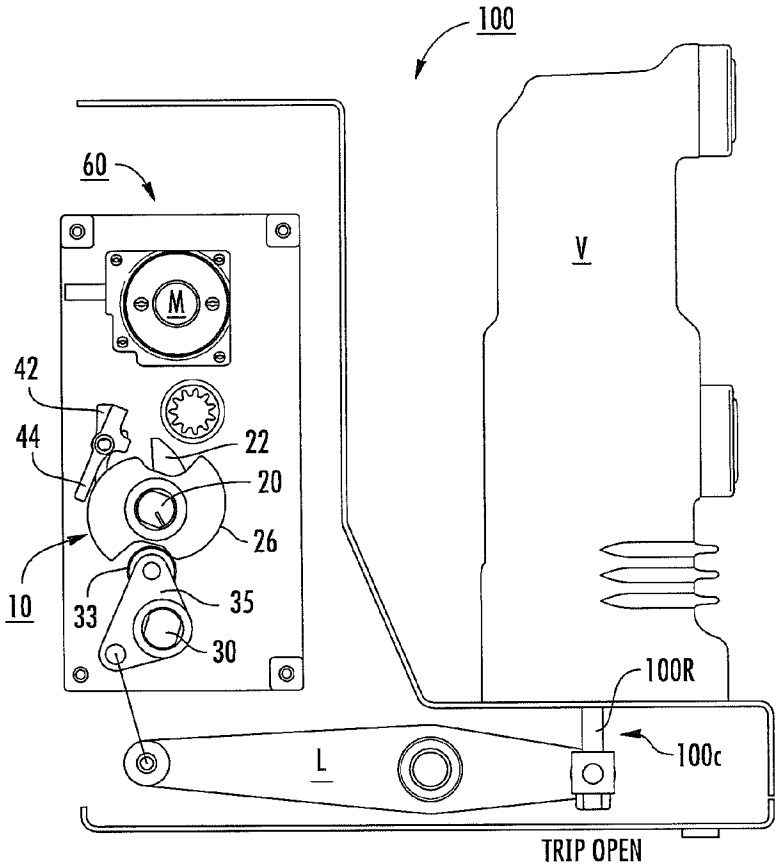
FIG. 16B is a cutaway side view of the operator mechanism shown in FIG. 16A as it is connected to a linkage that moves contacts to open and close a circuit breaker according to some embodiments of the present invention.
Figure 16A:
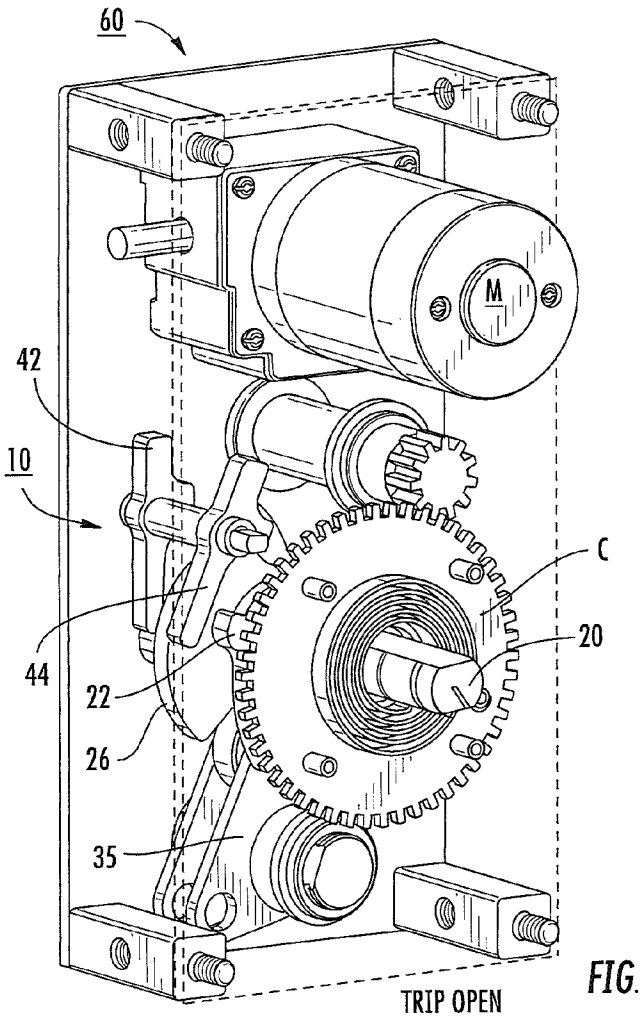
FIG. 16A is a partial side perspective view of an exemplary operator mechanism in a trip open position according to embodiments of the present invention.
Figure 16C:
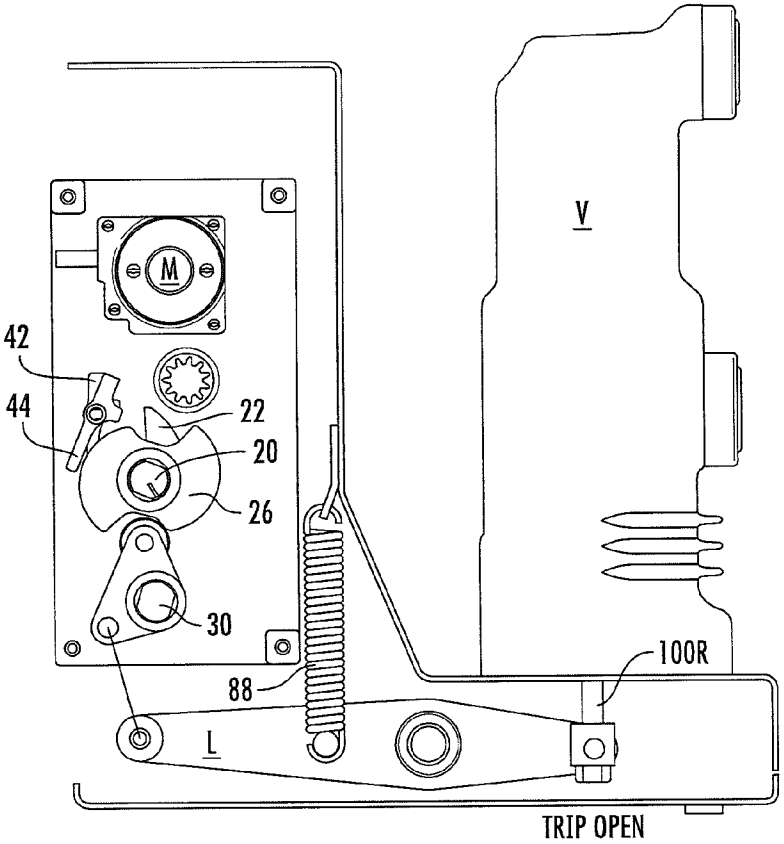
FIG. 16C is a cutaway side view of the operator mechanism shown in FIG. 16B and also illustrating an exemplary opening torsion spring according to embodiments of the present invention.

FIGS. 16A, 16B and 17A-17C illustrate exemplary operator mechanisms 60 with the trip latch assemblies 10 and a respective linkage L that is attached to the follower linkage 35 and is configured to pivot to cause an actuator 100R to move to open and close contacts 100*c* for the vacuum interrupter (VI) for a vacuum V circuit breaker 100. FIGS. 16A-16C illustrate an exemplary trip open position. FIGS. 17A-17C illustrate an exemplary trip close position. FIGS. 17B and 17C are the same except that FIG. 17C shows the torsion spring 88. FIGS. 16C and 17C illustrate the circuit showing an opening torsion spring 88 attached to the linkage L for driving the movement of the rod 100R and separation of contacts 100*c*.

Figure 18A:
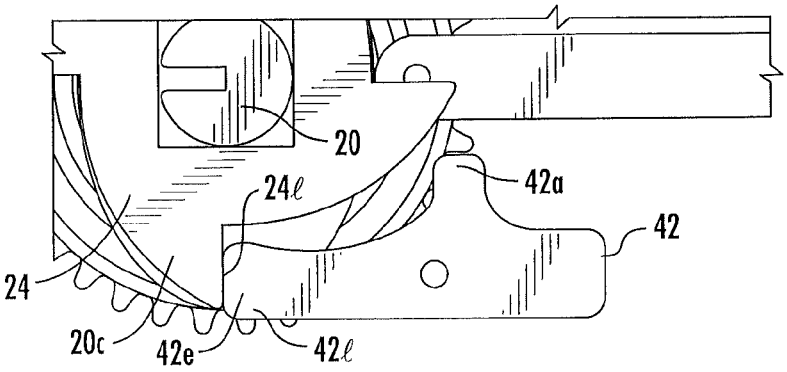
FIGS. 18A-18D are schematic illustrations of a latch and stop cam illustrating a self-recovery configuration where the latch self-resets after each trip event according to embodiments of the present invention.
Figure 18B:
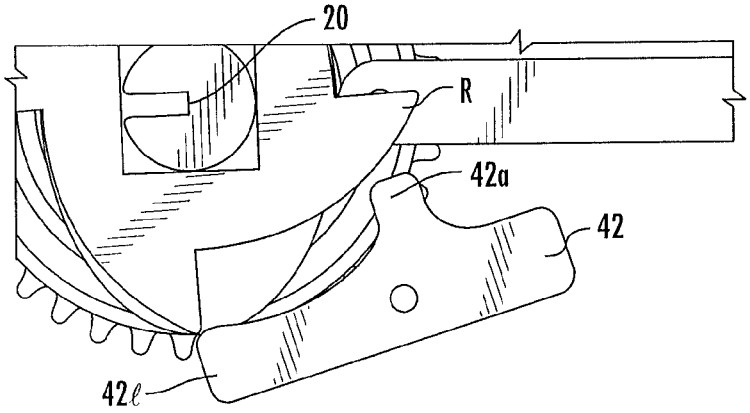
Figure 18C:
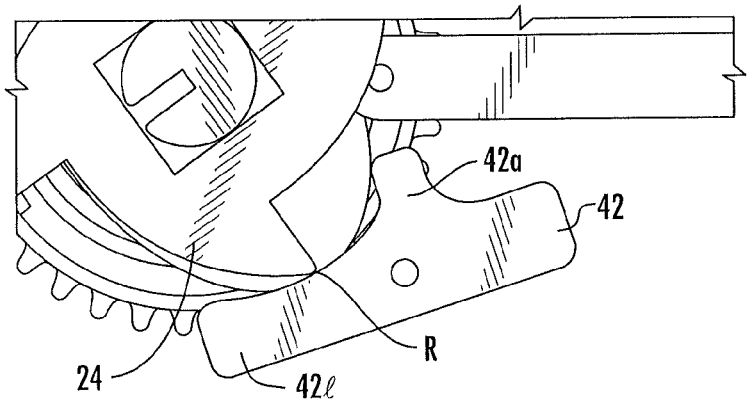
Figure 18D:
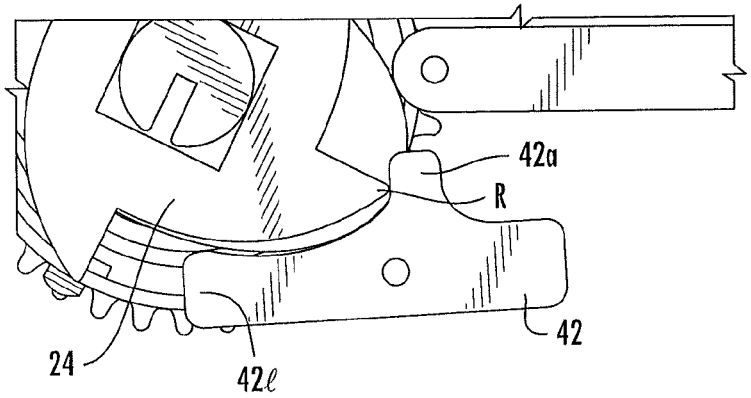
Figure 19C:
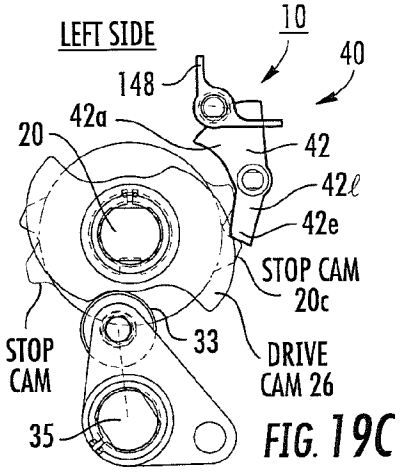
Figure 19B:
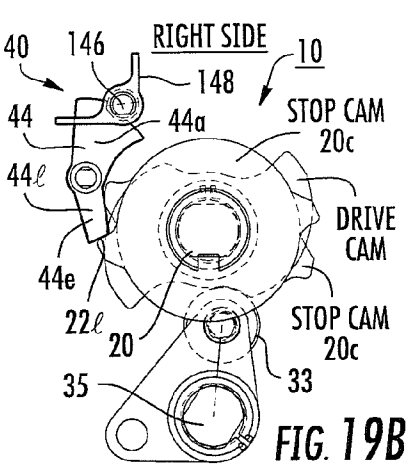
Figure 19A:
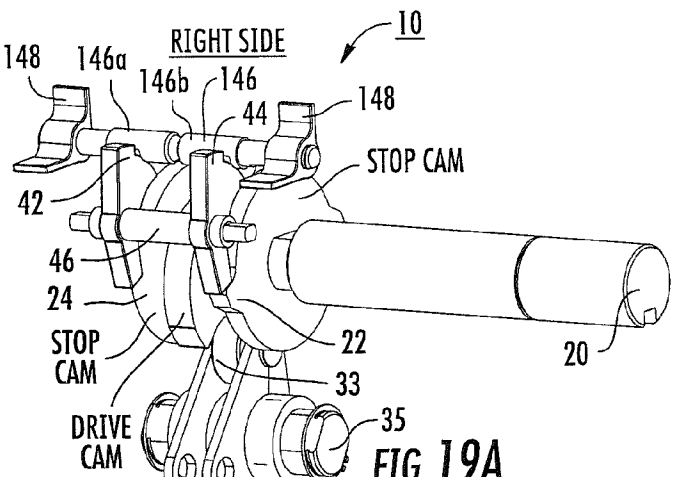

FIGS. 18A-18D illustrate a sequence of movements allowed by the self-recovery configuration of the latch assemblies 40 with a stop cam 20*c* according to some embodiments of the present invention. The term "self-recovery" means that the latch members 42, 44 automatically reset after each trip event. FIGS. 18A-18D illustrate the trip close latch 42 and associated stop cam 24 (a similar rotational self-recovery can occur for the trip open latch 44 and stop cam 22). As shown, (i) the latch 42 pivots outward off a hold position H where an end 42*e* rests against the stop cam ledge 24*l* (FIG. 18A), then (ii) the end of the latch 42*e* pivots outward (away from the stop cam) to place the inner corner of the end of the latch 42*e* outside the ledge 24*l* adjacent the recovery point R, then (iii) the stop cam 24 rotates and places the recovery point R against the latch body above the end of the latch 42*e* and below the arm 42*a* (FIG. 18C), then (iv) the stop cam 24 rotates further, thereby placing the recovery point R adjacent the arm 42*a* of the latch with the lower portion aligned with but spaced apart from the next holding ledge 24*l*, ready for a next trip event (FIG. 18D).

Figure 26C:
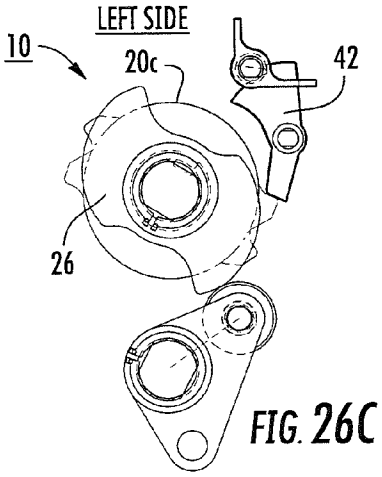
Figure 26B:
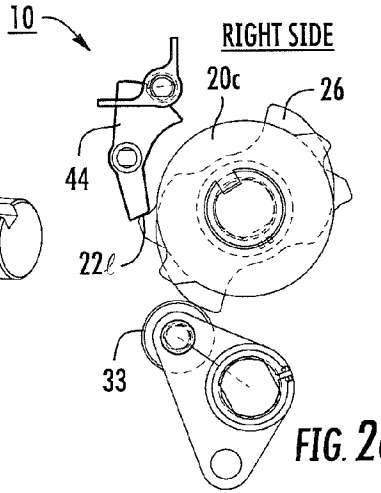
Figure 26A:
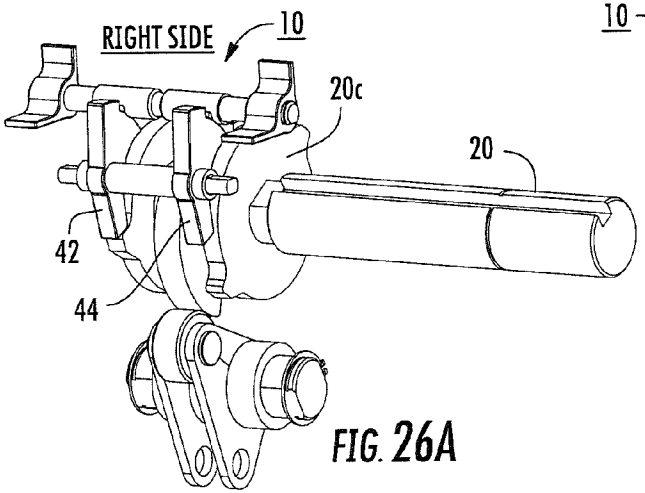

FIGS. 19A-26A illustrate another embodiment of the latch assembly 40 with a trip open latch 44 and a trip close latch 42 that can also have a self-recovery mode. These figures illustrate an exemplary operational sequence of a latch assembly 40 as the trip open latch 44 moves from a latch configuration (FIG. 19A-19C), then delatches (FIG. 20A-20C, 21A-21C) allowing the cam shaft 20 to rotate (FIGS. 22A-22C) which rotates the drive cam 26 to move from a trip opening position (FIGS. 20A, 21B) to a trip closing (FIGS. 22A-25A) to a trip closed latch configuration (FIGS. 26A-26C). The sequence shown occurs in under a single revolution of the cam shaft 20. As shown by comparing the shaft orientations of FIG. 19A with that shown in FIG. 25A, the cam shaft 20 can rotate by between about 180 to about 220 degrees between respective trip open and trip closed events.

FIGS. 19C-26C are left side views corresponding to the assembly shown in FIGS. 19A-26A. FIGS. 19C-26C also show the drive cam 26 on one side of both stop cams 20*c* rather than between two stop cams according to embodiments of the present invention.

Figure 20C:
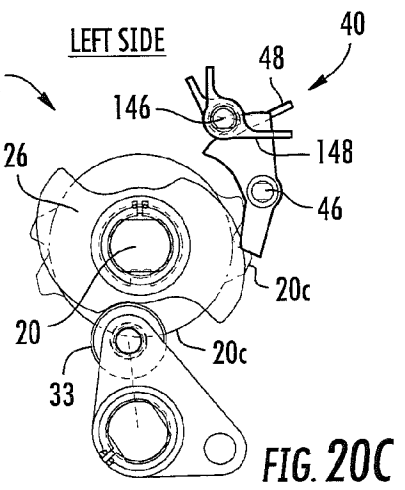
Figure 20B:
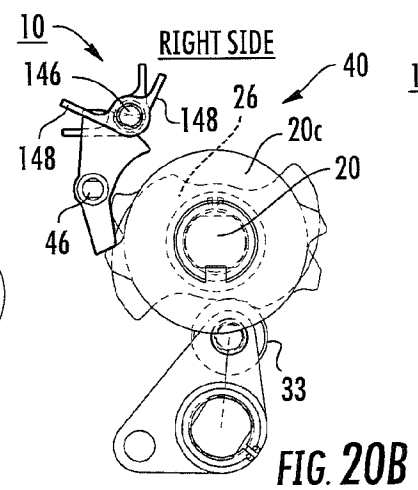
Figure 20A:
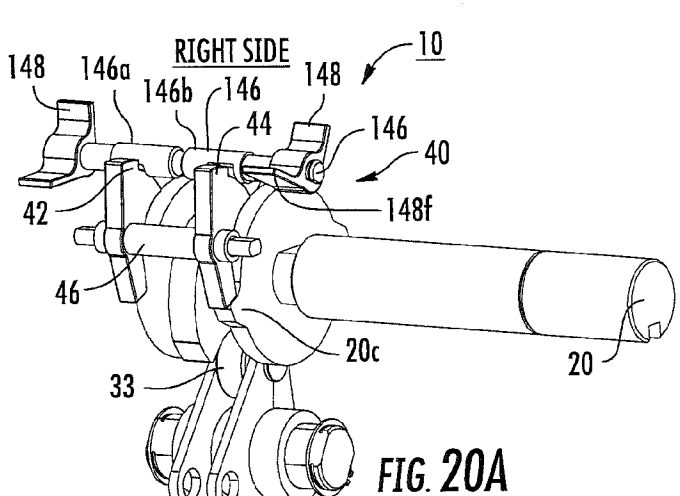
Figure 21C:
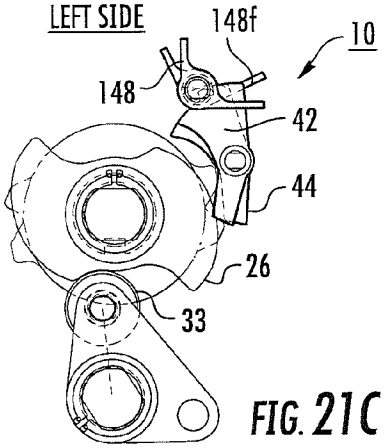
Figure 21B:
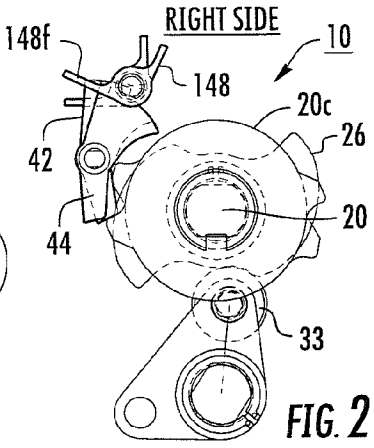
Figure 21A:
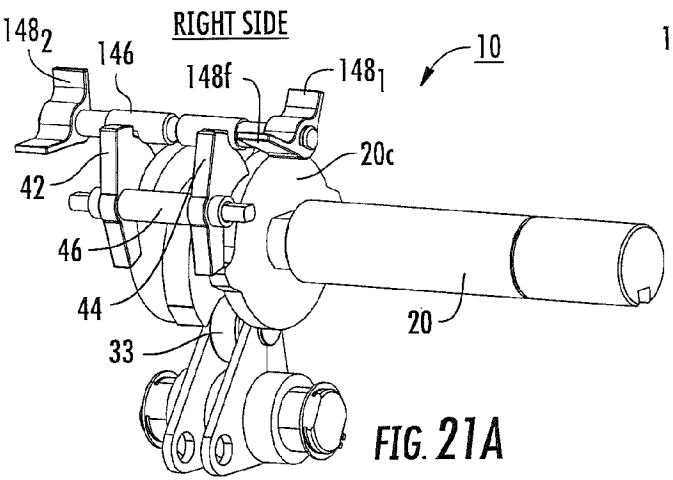
Figure 22C:
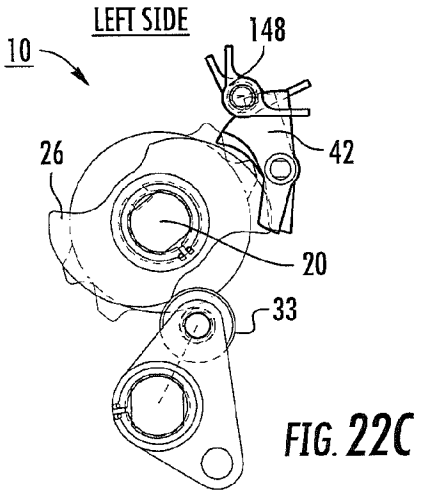
Figure 22B:
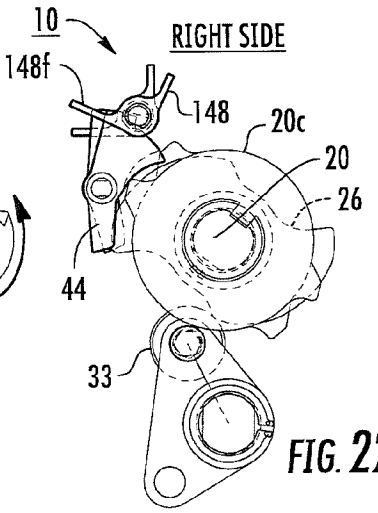
Figure 22A:
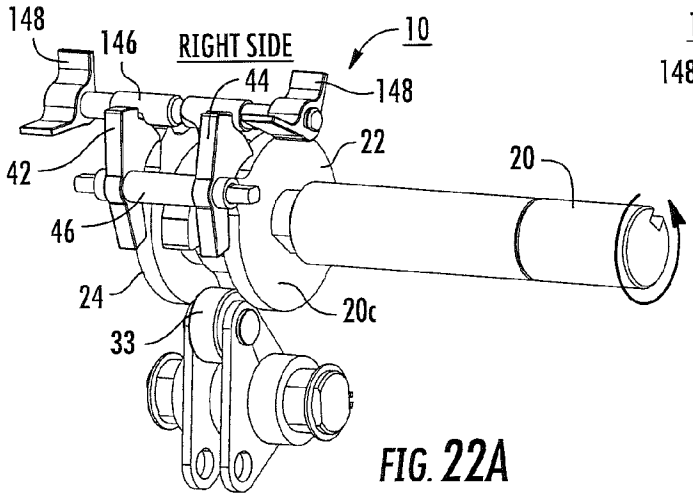
Figure 23C:
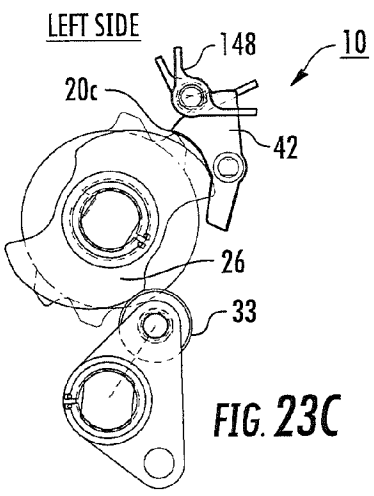
Figure 23B:
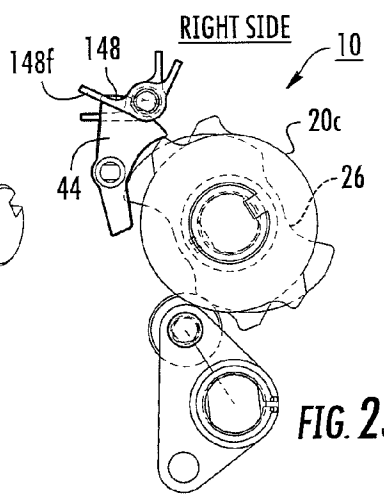
Figure 23A:
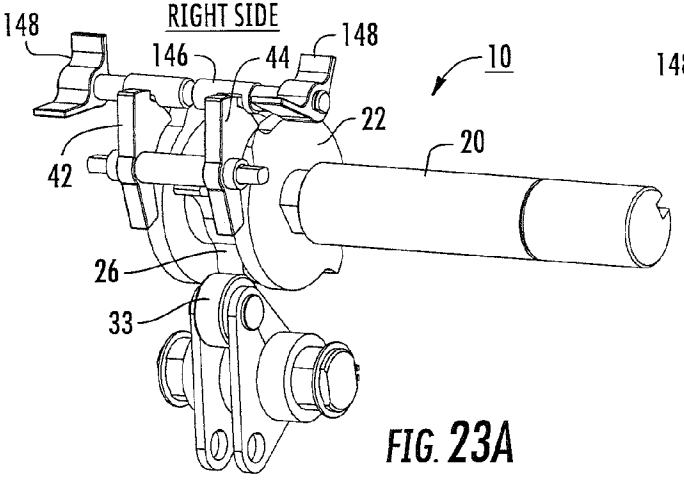

As shown, the latch assembly 40 can include a delatch control shaft 146 that is in cooperating alignment with the trip open and trip close latches 44, 42. The control shaft 146 can be configured as with separate shaft segments 146*a*, 146*b* (e.g., "half shafts") that independently rotate to independently rotate the control members 148. The control members 148 (shown as first and second members $\mathbf{148}_1$, $\mathbf{148}_2$) can have a foot 148*f* that pivots as the shaft segment rotates between defined orientations, e.g., a flat orientation (FIGS. 19A, 24A, for example) and an angled upward orientation (FIGS. 20A, 20B, for example). The control members 148 can allow the respective trip open and trip close latches 44, 42, to latch or delatch, respectively.

Figure 24C:
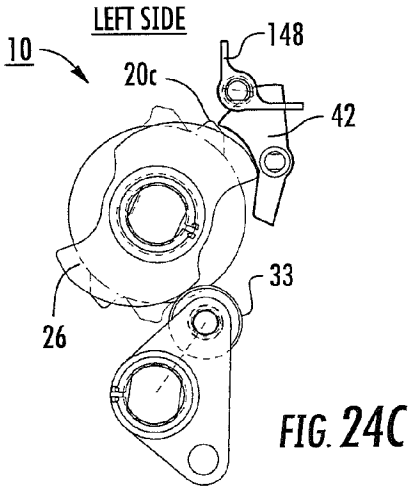
Figure 24B:
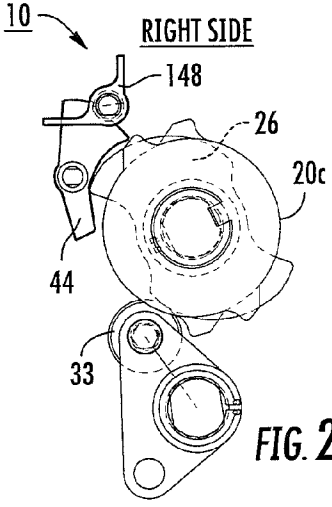
Figure 24A:
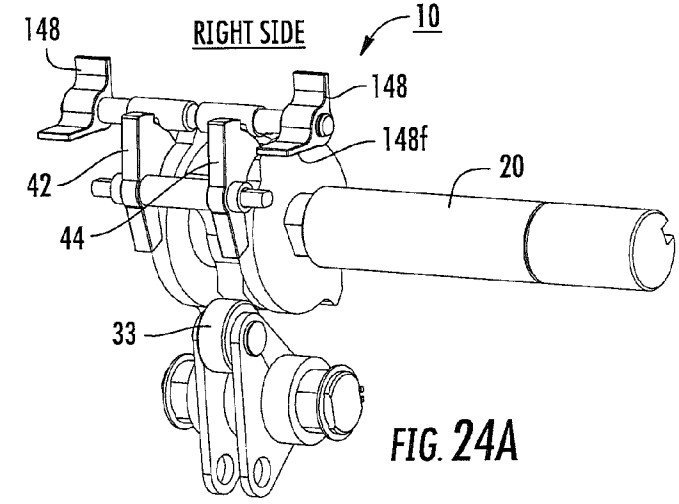
Figure 25C:
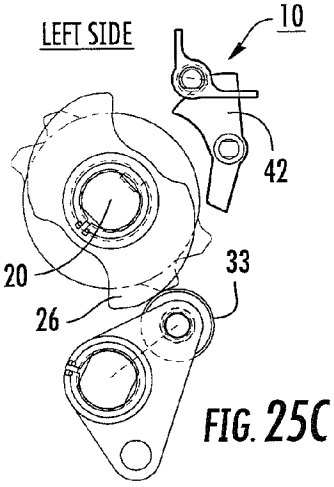
Figure 25B:
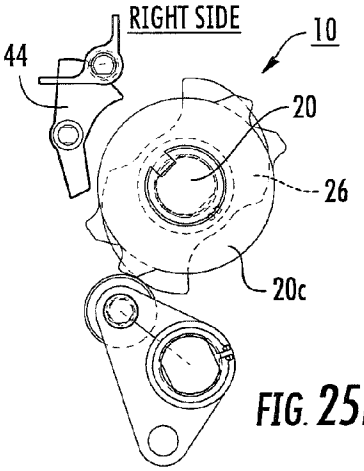
Figure 25A:
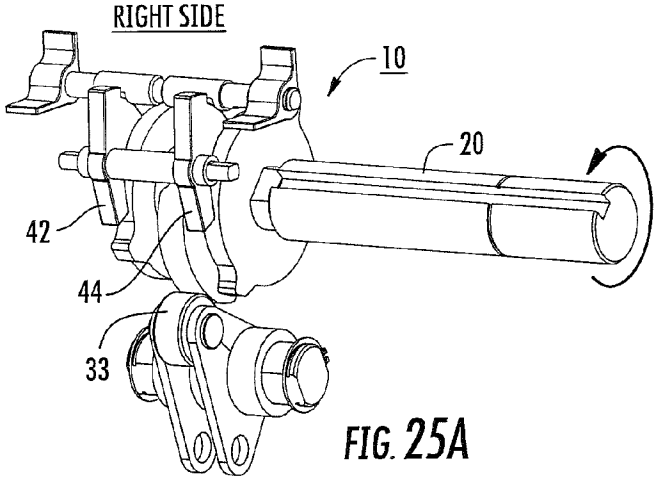

Referring to FIGS. 24A-24C, once the drive cam 26 rotates outside a respective trip open position, the delatch control member 148 can rotate back to its start position ready for a next delatch event after a next trip open latch event.

The opening operation sequence can be such that when the trip open latch 44 is tripped, the drive cam 26 is rotated clockwise by the clock spring C (or other closing spring configuration), the shaft 30 will be rotated clockwise by the torsion spring 88 without support by the drive cam 26, then the VI is opened.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A trip latch assembly for a circuit breaker, comprising:

a cam shaft;

a drive cam attached to the cam shaft adapted to communicate with a follower that directs an actuator to move between open and close positions of a circuit breaker;

at least one stop cam on the cam shaft, and at least one latch member in cooperating alignment with a respective at least one stop cam, wherein the latch member cooperates with the stop cam to maintain the actuator in the open position and/or close position to thereby maintain open and closed energy status of the circuit breaker, wherein the at least one latch member comprises a trip-open latch and/or a trip-close latch held by a trip latch shaft to be above and in cooperating alignment with a corresponding one of the at least one stop cams, the trip-open latch and/or trip-close latch having a downwardly extending leg that can tilt from vertical on the trip latch shaft.

2. The trip latch assembly of claim 1, wherein the at least one stop cam includes a first stop cam and a second stop cam held on the cam shaft, and wherein the at least one latch member includes a first latch member as the trip-open latch and a second latch member as the trip-close latch, the first latch member in cooperating alignment with the first stop cam and the second latch member in cooperating alignment with the second stop cam.

3. The trip latch assembly of claim 2, wherein the first and second stop cams have the same size and perimeter shape.

4. The trip latch assembly of claim 2, wherein the first stop cam and the first latch member and the second stop cam and the second latch member have self-recovery configurations to thereby automatically move through a sequence of positions to be reset for a subsequent trip event.

5. A trip latch assembly for a circuit breaker, comprising:

a cam shaft;

a drive cam attached to the cam shaft adapted to communicate with a follower that directs an actuator to move between open and close positions of a circuit breaker;

at least one stop cam on the cam shaft, and at, least one latch member in cooperating alignment with a respective at least one stop cam, wherein the latch member cooperates with the stop cam to maintain the actuator in the open position and/or close position to thereby maintain open and closed energy status of the circuit breaker, wherein the at least one stop cam comprises a perimeter profile with first and second ledges extending radially outward from a segment with a smaller radius to define respective holding points sized and configured to releasably receive a latch member.

6. The trip latch assembly of claim 5, wherein the first and second ledges are diametrically opposed.

7. The trip latch assembly of claim 5, wherein the at least one stop cam perimeter profile further comprises first and second fins that are circumferentially spaced apart with one of the holding points separating each side of the fins.

8. The trip latch assembly of claim 7, wherein the first and second fins are diametrically opposed.

9. A trip latch assembly for a circuit breaker, comprising:

a cam shaft;

a drive cam attached to the cam shaft adapted to communicate with a follower that directs an actuator to move between open and close positions of a circuit breaker;

at least one stop cam on the cam shaft, and at least one latch member in cooperating alignment with a respective at least one stop cam, wherein the latch member cooperates with the stop cam to maintain the actuator in the open position and/or close position to thereby maintain open and closed energy status of the circuit breaker, wherein the at least one stop cam includes a first stop cam and a second stop cam held on the cam shaft with the drive cam therebetween or with the drive cam positioned on a left or right side of the first and second stop cams, wherein the first and second stop cams comprise a perimeter profile with (a) first and second ledges extending radially outward from a segment with a smaller radius to define respective holding points sized and configured to releasably receive a latch member and (b) first and second fins defining recovery points that are circumferentially spaced apart with one of the holding points separating each side of the fins.

10. The trip latch assembly of claim 9, wherein the first and second ledges are diametrically opposed.

11. A trip latch assembly for a circuit breaker, comprising:

a cam shaft;

a drive cam attached to the cam shaft adapted to communicate with a follower that directs an actuator to move between open and close positions of a circuit breaker;

at least one stop cam on the cam shaft, and at least one latch member in cooperating alignment with a respective at least one stop cam, wherein the latch member cooperates with the stop cam to maintain the actuator in the open position and/or close position to thereby maintain open and closed energy status of the circuit breaker, wherein the at least one stop cam comprises a first stop cam and a second stop cam, wherein the at least one latch member comprises a trip-open latch and a trip-close latch both held by a trip latch shaft to be above the first and second stop cams, with the trip-open latch in cooperating alignment with the first stop cam and the trip-close latch in cooperating alignment with the second stop cam, wherein the trip-open latch and the trip-close latch have an inner facing arm and a respective downwardly extending leg that can tilt from vertical on the trip latch shaft.

12. A trip latch assembly for a circuit breaker, comprising:

a cam shaft;

a drive cam attached to the cam shaft adapted to communicate with a follower that directs an actuator to move between open and close positions of a circuit breaker;

at least one stop cam on the cam shaft, and at least one latch member in cooperating alignment with a respective at least one stop cam, wherein the latch member cooperates with the stop cam to maintain the actuator in the open position and/or close position to thereby maintain open and closed energy status of the circuit breaker, wherein the at least one stop cam includes a first stop cam and a second stop cam held on the cam shaft with the drive cam therebetween, and wherein the trip latch assembly further comprises a trip-open latch and a trip close latch, each held by a trip latch shaft so that the trip-open latch resides above and in cooperating alignment with the first stop cam and the trip-close latch resides above and in cooperating alignment with the second stop cam, the trip-open and trip-close latches having a respective downwardly extending leg that can tilt from vertical on the trip latch shaft, wherein the trip-open and trip-close latches are configured to cooperate with the first and second stop cams to hold and release closing and opening energy of an operator mechanism, wherein the trip latch assembly has a self-recovery configuration such that the trip-open latch and first stop cam and the trip-close latch and the second stop cam automatically move to reposition the trip-open latch and first stop cam and the trip-close latch and second stop cam to respective ready positions for a next trip event after respective trip events.

13. The trip latch assembly of claim 12, further comprising a follower residing against the drive cam, and a main shaft in communication with the follower configured to maintain open and closed energy status of the circuit breaker via an operator mechanism using the trip latch assembly.

14. A circuit breaker, comprising:

a drive cam held on a cam shaft;

a follower in communication with the drive cam;

a linkage attached to (i) the follower and (ii) a main shaft to open and close the circuit breaker; and a trip latch assembly configured to maintain open and closed energy status of the breaker, the trip latch assembly comprising:

a first stop cam held on the cam shaft;

a second stop cam held on the cam shaft axially spaced apart from the first stop cam;

a trip-open latch held on a trip latch shaft in cooperating alignment with the first stop cam; and a trip-close latch held on the trip latch shaft in cooperating alignment with the second stop cam, wherein the trip latch assembly is configured to latch the drive cam in trip open and trip closed positions and de-latch to release the drive cam and allow the drive cam to rotate to thereby hold and release closing and opening energy of an operator mechanism.

15. The circuit breaker of claim 14, wherein the circuit breaker is a vacuum circuit breaker.

16. The circuit breaker of claim 14, wherein the trip-open and trip-close latches comprise legs extending from the trip latch shaft that are able to tilt while held on the trip latch shaft in response to a profile shape of the first and second stop cams, wherein the profile shape of the stop cams comprise circumferentially spaced apart ledges that define respective first and second trip open and trip close holding points and circumferentially spaced apart fins that define first and second recovery points, and wherein the trip-open and trip close latches cooperate with the first and second stop cams to provide three different locked/latched positions: (a) an interlock position; (b) a trip close position; and (c) a trip-open position.

17. The circuit breaker of claim 14, wherein the trip-open and trip-close latches each comprises an arm that extends inwardly to face a respective stop cam and a leg that extends below the arm and the trip latch shaft, wherein the legs are able to tilt while held on the trip latch shaft in response to a profile shape of the first and second stop cams.

18. The circuit breaker of claim 14, wherein the trip open and trip close latches are configured to cooperate with the first and second stop cams to hold and release closing and opening energy of an operator mechanism using a single cam shaft, wherein the trip latch assembly has a self-recovery configuration such that the trip-open latch and first stop cam and the trip-close latch and the second stop cam automatically move to reposition the trip-open latch and first stop cam and the trip-close latch and second stop cam to a respective ready position for a next trip event after respective trip events whereby the trip-open latch and trip-close latch have a self recovery mode that does not require a spring.

19. A method of latching/de-latching a circuit breaker in/from open and closed positions, comprising:

pushing an upper portion of a trip-open latch toward a first stop cam held on a cam shaft with a drive cam and a second stop cam to release the trip-open latch from a stop defined by a hold position on the first stop cam; then automatically rotating the drive cam a defined amount sufficient to allow a change in energy status of the circuit breaker; then rotating the second stop cam so that a trip close-latch engages a stop at a hold position on the second stop cam to thereby lock the drive cam in position;

automatically pivoting the trip-open latch and rotating the first stop cam from the hold position to a recovery positions so as to operate in a self-recovery sequence to be reset for a next trip event; and automatically pivoting the trip-close latch and rotating the second stop cam from the hold position to a recovery positions so as to operate in a self-recovery sequence to be reset for a next trip event.

* * * * *